US011730263B2

(12) United States Patent
Boudreault

(10) Patent No.: US 11,730,263 B2
(45) Date of Patent: Aug. 22, 2023

(54) SYSTEM FOR STORING AND DELIVERING FOOD TRAYS

(71) Applicant: REGETHERMIC CANADA INC., Varennes (CA)

(72) Inventor: Jean-Pierre Boudreault, Carignan (CA)

(73) Assignee: REGETHERMIC CANADA INC., Quebec (CA)

( * ) Notice: Subject to any disclaimer, the term of this patent is extended or adjusted under 35 U.S.C. 154(b) by 0 days.

(21) Appl. No.: 17/855,569

(22) Filed: Jun. 30, 2022

(65) Prior Publication Data

US 2023/0000246 A1 Jan. 5, 2023

Related U.S. Application Data

(60) Provisional application No. 63/218,014, filed on Jul. 2, 2021.

(51) Int. Cl.
*A47B 31/02* (2006.01)
*A47B 31/00* (2006.01)

(52) U.S. Cl.
CPC ..... *A47B 31/02* (2013.01); *A47B 2031/002* (2013.01); *A47B 2031/003* (2013.01); *A47B 2031/023* (2013.01); *A47B 2031/026* (2013.01)

(58) Field of Classification Search
CPC ..... A47B 31/02; A47B 2031/023; A47B 2031/026; A47B 2031/002; A47B 2031/003
See application file for complete search history.

(56) References Cited

U.S. PATENT DOCUMENTS 3,042,384 A 7/1962 Bauman
3,160,452 A * 12/1964 Rothman ..... H05B 3/68 312/236
3,205,033 A 9/1965 Stentz
3,222,114 A 12/1965 Stentz
3,275,393 A * 9/1966 Conklin ..... A47J 39/006 219/214
3,311,434 A 3/1967 Dyer et al.
(Continued)

FOREIGN PATENT DOCUMENTS

EP 0161178 A1 11/1985
EP 0143066 B1 3/1987
(Continued)

OTHER PUBLICATIONS

Machine translation in English of EP0143066.
(Continued)

*Primary Examiner* — Daniel J Rohrhoff
(74) *Attorney, Agent, or Firm* — Ryan Kromholz & Manion, S.C.

(57) ABSTRACT

The system is used for storing and delivering individual food trays having opposite hot and cold food products areas. The housing includes two separate chambers that can receive food trays through a respective one among two opposite lateral openings. Among other things, from the standpoint of an attendant at a food tray assembly station, this system allows using the same left-right food tray orientation regardless of which one of the lateral openings is directly set in front of the standpoint after repositioning the whole housing.

20 Claims, 23 Drawing Sheets

(56) References Cited

U.S. PATENT DOCUMENTS

| | | | | | |
|---|---|---|---|---|---|
| 3,908,749 | A * | 9/1975 | Williams | A47J 39/006 | 219/403 |
| 3,982,584 | A * | 9/1976 | Spanoudis | A47J 39/006 | 312/236 |
| 4,005,745 | A | 2/1977 | Colato et al. | | |
| 4,138,504 | A * | 2/1979 | Mack | A47J 39/006 | 426/520 |
| 4,203,486 | A | 5/1980 | Rubbright et al. | | |
| 4,323,110 | A | 4/1982 | Rubbright et al. | | |
| 4,361,014 | A | 11/1982 | Blain | | |
| 4,730,100 | A | 3/1988 | Pingelton | | |
| 5,093,556 | A | 3/1992 | Oelfke | | |
| 5,159,973 | A * | 11/1992 | Pennington | F25D 23/12 | 126/400 |
| 5,403,997 | A | 4/1995 | Wimpee et al. | | |
| 5,655,595 | A | 8/1997 | Westbrooks, Jr. | | |
| 5,771,959 | A * | 6/1998 | Westbrooks, Jr. | A23L 3/365 | 219/386 |
| 5,809,798 | A | 9/1998 | Clarke et al. | | |
| 5,895,104 | A | 4/1999 | Grandi | | |
| 5,975,202 | A | 11/1999 | Grandi | | |
| 6,073,547 | A * | 6/2000 | Westbrooks, Jr. | A47J 39/003 | 312/410 |
| 6,105,818 | A | 8/2000 | Speranza | | |
| 6,634,181 | B2 | 10/2003 | Kim et al. | | |
| 6,637,320 | B2 * | 10/2003 | Grandi | A47J 39/006 | 99/476 |
| 6,684,657 | B1 * | 2/2004 | Dougherty | B62B 3/006 | 165/918 |
| 6,802,367 | B1 * | 10/2004 | Westbrooks, Jr. | F25D 25/00 | 165/918 |
| 6,870,136 | B1 | 3/2005 | Majordy | | |
| 7,025,121 | B2 * | 4/2006 | Whitehead | F25D 15/00 | 165/41 |
| 7,975,604 | B2 | 7/2011 | Boryca et al. | | |
| 8,227,727 | B2 | 7/2012 | Fontan | | |
| 8,516,953 | B2 | 8/2013 | Fiori | | |
| 9,386,845 | B2 * | 7/2016 | Wu | B62B 3/00 | |
| 9,957,050 | B2 | 5/2018 | Moran | | |
| 9,976,750 | B1 * | 5/2018 | Kestner | A47J 36/2483 | |
| 10,273,010 | B2 | 4/2019 | Moran et al. | | |
| 2008/0289514 | A1 | 11/2008 | Speranza | | |
| 2017/0208940 | A1 * | 7/2017 | Boudreau | A47F 3/02 | |
| 2022/0087460 | A1 | 3/2022 | Speranza et al. | | |

FOREIGN PATENT DOCUMENTS

| | | | |
|---|---|---|---|
| EP | 0656186 | B1 | 3/1999 |
| EP | 0919174 | B1 | 9/2003 |
| EP | 1116465 | B1 | 5/2004 |
| EP | 1443838 | B1 | 12/2005 |
| EP | 1836928 | A2 | 9/2007 |
| EP | 1584876 | B1 | 11/2009 |
| EP | 2316317 | B1 | 11/2012 |
| EP | 2123191 | B1 | 9/2014 |
| EP | 1902647 | B1 | 11/2016 |
| FR | 2068042 | A5 | 8/1971 |
| FR | 2386291 | A1 | 11/1978 |
| FR | 2420947 | A1 | 10/1979 |
| FR | 2605395 | A1 | 4/1988 |
| FR | 2684281 | A1 | 6/1993 |
| FR | 2766343 | B1 | 9/1999 |
| FR | 2878236 | B1 | 2/2007 |
| FR | 2868671 | B1 | 8/2008 |
| FR | 2954062 | B1 | 7/2012 |
| GB | 2258996 | A | 3/1993 |
| GB | 2264891 | A | 9/1993 |
| GB | 2284905 | A | 6/1995 |
| GB | 2297147 | A | 7/1996 |
| GB | 2424476 | A | 9/2006 |
| JP | 3121566 | B2 | 1/2001 |
| JP | 3285300 | B2 | 5/2002 |
| JP | 3685181 | B2 | 8/2005 |
| JP | 3714085 | B2 | 11/2005 |
| JP | 3896225 | B2 | 3/2007 |
| JP | 4105477 | B2 | 6/2008 |
| JP | 4408576 | B2 | 2/2010 |
| JP | 4458693 | B2 | 4/2010 |
| JP | 4471512 | B2 | 6/2010 |
| JP | 4471518 | B2 | 6/2010 |
| JP | 4471519 | B2 | 6/2010 |
| JP | 5348769 | B2 | 11/2013 |
| JP | 5405232 | B2 | 2/2014 |
| JP | 5430321 | B2 | 2/2014 |
| JP | 2016209286 | A | 12/2016 |
| JP | 6332789 | B2 | 5/2018 |
| JP | 6378967 | B2 | 8/2018 |
| JP | 6692091 | B2 | 5/2020 |
| WO | 9608190 | A1 | 3/1996 |

OTHER PUBLICATIONS

Machine translation in English of EP0161178.
Machine translation in English of EP0656186.
Machine translation in English of EP0919174.
Machine translation in English of EP1116465.
Machine translation in English of EP1443838.
Machine translation in English of EP1584876.
Machine translation in English of EP1902647.
Machine translation in English of EP2123191.
Machine translation in English of EP2316317.
Machine translation in English of FR2068042.
Machine translation in English of FR2386291 (B1 version).
Machine translation in English of FR2420947 (B1 version).
Machine translation in English of FR2605395.
Machine translation in English of FR2684281.
Machine translation in English of FR2766343.
Machine translation in English of FR2868671.
Machine translation in English of FR2878236.
Machine translation in English of FR2954062.
Machine translation in English of JP3121566B2.
Machine translation in English of JP3285300B2.
Machine translation in English of JP3685181B2.
Machine translation in English of JP3714085B2.
Machine translation in English of JP3896225B2.
Machine translation in English of JP4105477B2.
Machine translation in English of JP4408576B2.
Machine translation in English of JP4458693B2.
Machine translation in English of JP4471512B2.
Machine translation in English of JP4471518B2.
Machine translation in English of JP4471519B2.
Machine translation in English of JP5348769B2.
Machine translation in English of JP5405232B2.
Machine translation in English of JP5430321B2.
Machine translation in English of JP6332789B2.
Machine translation in English of JP6378967B2.
Machine translation in English of JP6692091B2.
Machine translation in English of JP2016209286A.

* cited by examiner

SYSTEM FOR STORING AND DELIVERING FOOD TRAYS

CROSS-REFERENCE TO RELATED APPLICATION

The present case claims the benefit of U.S. patent application No. 63/218,014 filed on 2 Jul. 2021. The entire contents of this prior patent application are hereby incorporated by reference.

TECHNICAL FIELD

The technical field relates generally, among other things, to systems for storing and delivering food trays.

BACKGROUND

Food trays are commonly used in institutions, such as hospitals and rest homes, and in a number of other facilities to serve meals containing various hot and cold food products. The upper surface of these food trays is often segmented into a hot food products area on one side (right or left) and a cold food products area on the opposite side, and each food products area may include more than one individual compartment delimited by ridges or other features provided on the upper surface of the food trays. Hot and cold food products are put into corresponding compartments during the assembly of the food trays, for instance at a food tray assembly station in a commercial kitchen. Each food tray can then be loaded by an attendant into a wheeled cart or trolley so that they can be stored and eventually transported closer to the persons for which these meals were prepared, among other things. The food trays are generally given to these persons only at the beginning of the mealtime.

Food tray delivery carts can be designed to provide heat to the hot food products at the appropriate time without having to access the food trays, and many different systems have been suggested over the years to implement this approach. In these systems, the interior volume inside a food tray delivery cart is generally divided into two zones, namely a hot zone and a cold zone. The food trays are inserted into vertically stacked spaces when they are loaded into the housing from a lateral opening. Food trays generally have a substantially rectangular shape, and each food tray is usually loaded by first inserting one of their long sides into the space at a given loading level, and by sliding the food tray sideways until it is entirely inside the housing of the cart. Each food tray must be oriented so that their hot and cold food products areas are each placed into the correct zone.

Some food tray delivery carts can be designed to hold only a single stack of food trays. Others can be designed to hold two adjacent stacks of food trays to increase the capacity, with the food trays in both stacks sharing the same hot and cold zones. In other words, the hot food products area on the food trays of both stacks will be located in the same hot zone, and the cold food products area on the food trays of both stacks will be located in the same cold zone. However, having two stacks of food trays but only a single lateral opening requires that two food trays must be inserted at least some of the loading levels. The second food tray inserted at a given level will push the first food tray deeper until it reaches the end position. However, when the meals are served, reaching the food tray at the deeper end will often be more difficult, and the risks of inadvertently touching food products or surfaces on other food trays are increased when an attendant must insert a hand well within the housing to reach a food tray. The design of such a system can also be challenging, particularly for the thermal barrier that creates the separation between the hot and cold zones within the internal space of the housing. Having lateral openings on opposite sides can alleviate these difficulties. It allows, among other things, the food trays of the first stack to be loaded and retrieved from one side and the food trays of the second stack to be loaded and retrieved from the opposite side.

The insertion of the food trays inside a cart at the end of a food tray assembly station being essentially a manual operation, it is generally desirable that the distance over which each food tray is hand-carried by an attendant during the loading process be minimized. This loading process, for instance, can involve picking up a food tray from a conveyor, with the food products already on it, and then inserting it inside the cart through one of the lateral openings. The lateral opening through which food trays are currently being loaded is positioned very close to where this attendant performs the loaded process. Hence, a food tray delivery cart having two opposite lateral openings is often repositioned at some point so as to bring the opposite lateral opening at the optimal position before food trays can be loaded in the second stack. For instance, the food tray delivery cart can be pivoted so as to bring the second lateral opening at the optimum position. This repositioning of the cart can even be done more than once until the loading process for this cart is complete and both lateral doors are closed. The cart can then be moved away to make room for a next cart.

Now, since the hot and cold zones inside a cart extend from one lateral side to the other, the orientation of the food trays to be loaded through a second lateral opening must be reversed, i.e., pivoted over 180 degrees around a vertical axis, compared to the orientation of the ones that were loaded through the first lateral opening. For instance, from the standpoint of the attendant at a loading workstation, if the hot food products area on the food trays loaded through the first lateral opening was on the left-hand side, the hot food products area on the food trays to be inserted through the second lateral opening must be on the right-hand side once the cart is repositioned. If not, the hot and cold food products areas on the second set of food trays will be misplaced. This rule is easy to forget, and it is inherently prone to errors. Unless such mistake is detected soon enough when it occurs, the cold food products on the misoriented food trays will be heated prior to serving while the hot food products will not. This will most likely result in food being wasted, additional work for the attendants and caretakers, and undesirable delays for the persons expecting the meals, among other things.

It is worth mentioning that in general, there are also various other difficulties and challenges associated with systems and methods for storing and delivering food trays. Some of them can be complicated to solve or to mitigate without creating new issues or drawbacks. For instance, improvements made to increase the efficiency of some of the parts could increase the overall manufacturing costs far beyond what most buyers are ready to pay for the added benefits, or they may result in major inconveniences during cleaning operations because some of the newly designed parts are now more difficult to access compared to the previous ones. Many other situations exist.

There is thus always room for further improvements to overcome or mitigate at least some of the difficulties and challenges in this area of technology.

SUMMARY

The proposed concept involves a new approach in the design of systems for storing and delivering food trays. This new approach allows, among other things, the orientation of the food trays to remain the same regardless of the lateral opening through which they are loaded. It also suggests a number of other improvements, advancements and refinements on various components and aspects, for instance ones that are related to the manufacturing of the systems, or the cleaning and maintenance operations, to name just a few.

Among other things, there is provided a system for storing and delivering individual food trays, each food tray having separate hot and cold food products areas on opposite sides of a transversal demarcation line, the system including: a housing having two lateral doors to selectively open and close a respective one among two opposite lateral openings, the housing including separate first and second chambers, each chamber having an enclosed internal space accessed through a respective one of the lateral openings, each chamber including: a tray supporting arrangement having a plurality of vertically spaced stacking positions, each stacking position corresponding to a stowage space for receiving one of the food trays with the chamber through the respective lateral opening; and a vertically extending thermal barrier to divide the enclosed internal space within the chamber into separate vertically extending hot and cold food products sections along the demarcation line on the food trays; and when viewed from above, the hot food products section of the first chamber and the hot food products section of the second chamber are diametrically opposite to one another, and the cold food products section of the first chamber and the cold food products section of the second chamber are diametrically opposite to one another.

Details on the different aspects of the proposed concept and the various possible combinations of technical characteristics or features will become apparent in light of the following detailed description and the appended figures.

DETAILED DESCRIPTION

Figure 1:
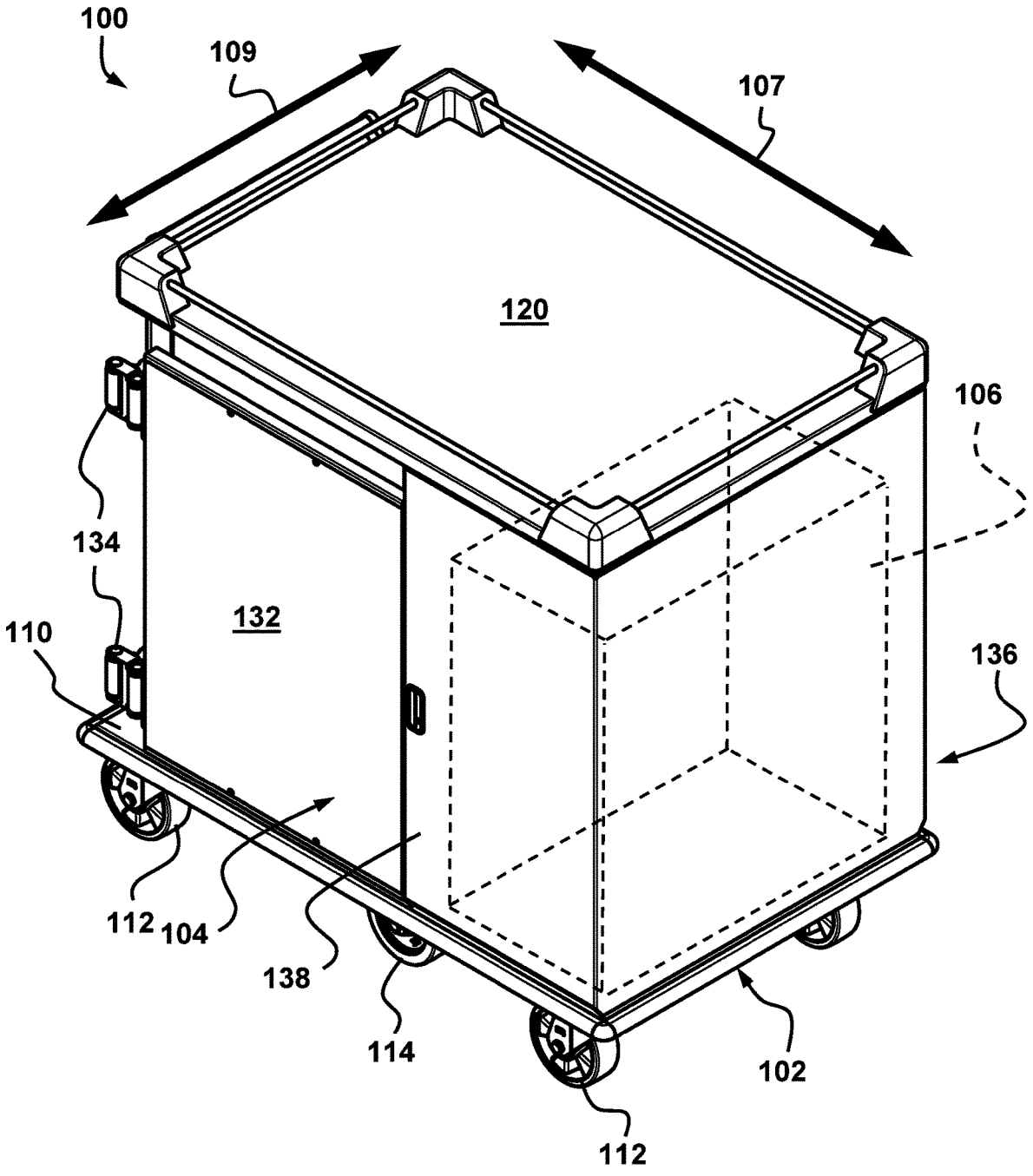
FIG. 1 is a front isometric view of an example of a system for storing and delivering food trays in which the proposed concept is implemented.
Figure 2:
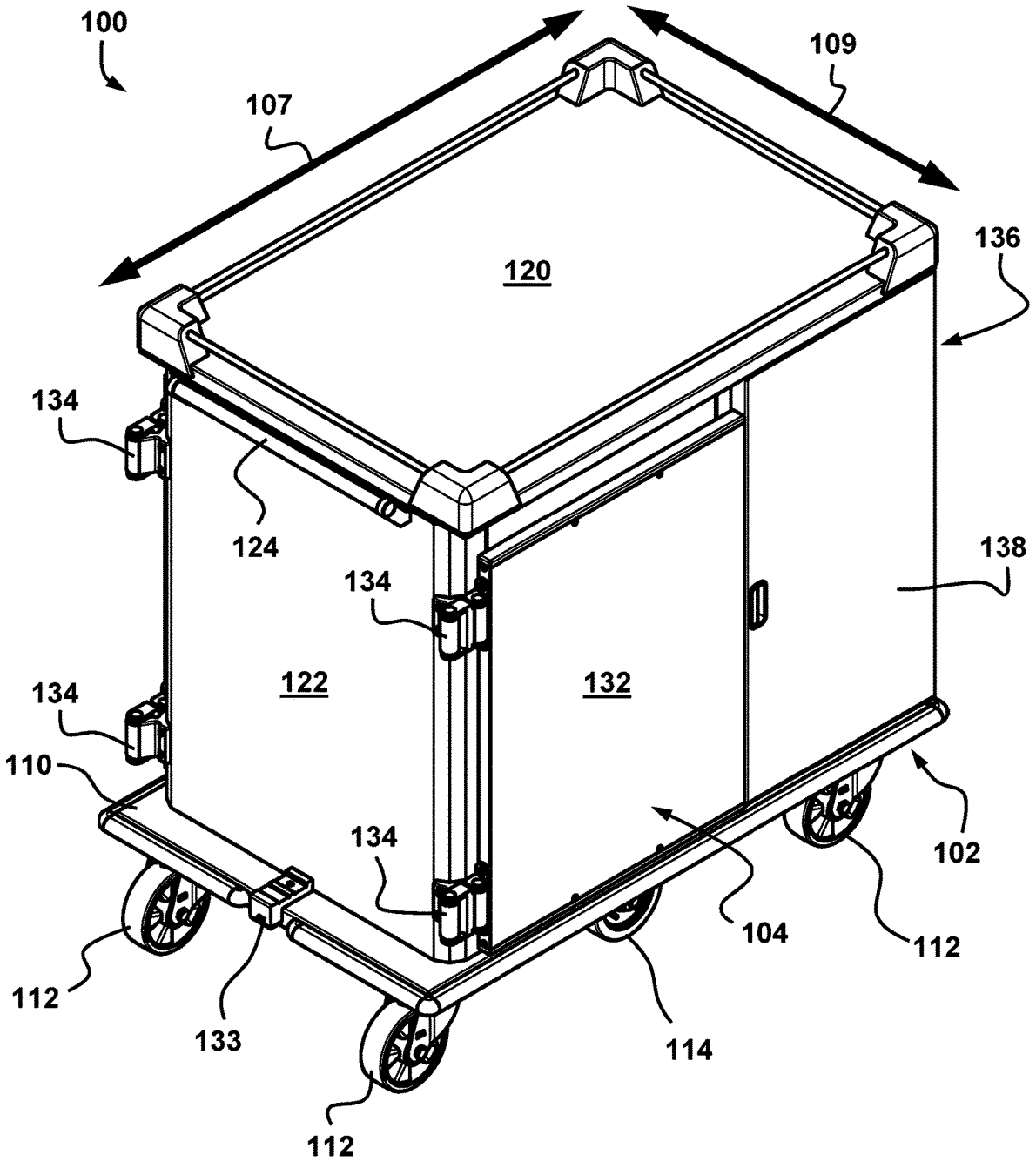
FIG. 2 is a rear isometric view of the system of FIG. 1.

FIG. 1 is a front isometric view of an example of a system 100 for storing and delivering food trays in which the proposed concept is implemented. FIG. 2 is a rear isometric view thereof. This system is only an example. Other configurations and arrangements are possible.

The system 100 can include a carriage 102, a housing 104 and an onboard heating/cooling unit 106 mounted onto the carriage 102, as shown for instance in FIGS. 1 and 2. It can also include other components. The illustrated system 100 is configured to create a self-contained food tray delivery cart 108 where the various devices are integrated or packaged into the same apparatus. Other configurations and arrangements are possible. Among other things, the housing 104 and the heating/cooling unit 106 can be provided separately, the heating/cooling unit 106 being for instance located in or accessed through a docking station while the food tray delivery cart 108 includes only the housing 104 and the carriage 102 on which it is mounted. The carriage 102 can be designed differently, and it can even be a device that does not include wheels and/or that is part of another machine, apparatus or vehicle. Accordingly, a carriage does not necessarily need to be present, n particular when a system 100 is manufactured and sold. Other variants are possible as well.

It should be noted that the term "food tray delivery cart" is used for the sake of brevity. The food tray delivery cart 108 is designed, among other things, to store food trays and to maintain the food products on the food trays at desired temperatures before the meals are served (i.e., delivered) to the persons for which these meals were prepared. It also allows the food trays to be transported to or at least closer to these persons. However, notwithstanding the presence of the word "delivery" in the term "food tray delivery cart", the distance over which the food trays are transported after being loaded in a food tray delivery cart, for instance between a food tray assembly station in a commercial kitchen and the location where they will be retrieved to be given to the persons having these meals, is relatively unimportant. In some implementations, the food trays can even remain substantially at the same location between their loading and unloading. Hence, the term "food tray delivery cart" must be understood in this context.

The exterior of the food tray delivery cart 108 in the example of FIGS. 1 and 2 has a generally boxlike aspect and a generally rectangular shape when viewed from above. The long axis is referred to hereafter as the longitudinal axis 107, and the short axis is referred to hereafter as the transversal axis 109. The longitudinal axis 107 can also be broadly defined as a line extending in the lengthwise direction, and the transversal axis 109 as a line extending in the widthwise direction. The illustrated food tray delivery cart 108 is designed so that its usual forward-rearward direction of travel is parallel to the longitudinal axis 107. The food tray delivery cart 108 generally has opposite front and rear sides, and opposite left and right sides. It also has a top side and a bottom side. Other configurations and arrangements are possible. Among other things, other shapes and designs are possible, and non-rectangular and/or irregular shapes are possible. The length does not always need to be a larger dimension compared to the width. The relative position, or layout, of the various components or parts can also be different. For instance, while the heating/cooling unit 106 is said to be positioned at the front of the food tray delivery cart 108 in the example shown in FIGS. 1 and 2, some implementations can be configured differently. The left, right, front and rear sides are all lateral sides. Hence, although the illustrated example shows the opposite lateral sides are the left and right sides of the implementation, they can also be the front and rear sides in others. Other variants are possible as well.

The carriage 102 of the illustrated example includes a bottom base panel 110 and a plurality of caster wheels 112, 114 attached under it to engage the floor or ground that supports the food tray delivery cart 108. The wheels 112 at the corners can be directional wheels, i.e., that can also pivot about a vertical axis, while the wheels 114 at the center have a fixed orientation, as shown in this example. The bottom base panel 110 can be essentially a flat rectangular board that is slightly larger than the components mounted thereon, as shown. This bottom base panel 110 can be made of stainless steel or the like. Bumpers made of a resilient material can be provided around its periphery to absorb shocks if the carriage 102 runs into another object or a fixed structure. Other configurations and arrangements are possible. Among other things, the number, configuration, and type of wheels under the carriage 102 can be different in some implementations. Other materials are possible besides stainless steel or the like. The bottom base panel 110 can be designed differently and can even be omitted in some implementations, for instance by attaching wheels or the like directly under the housing 104. As aforesaid, wheels can also be omitted in some implementations. Other variants are possible as well.

Figure 8:
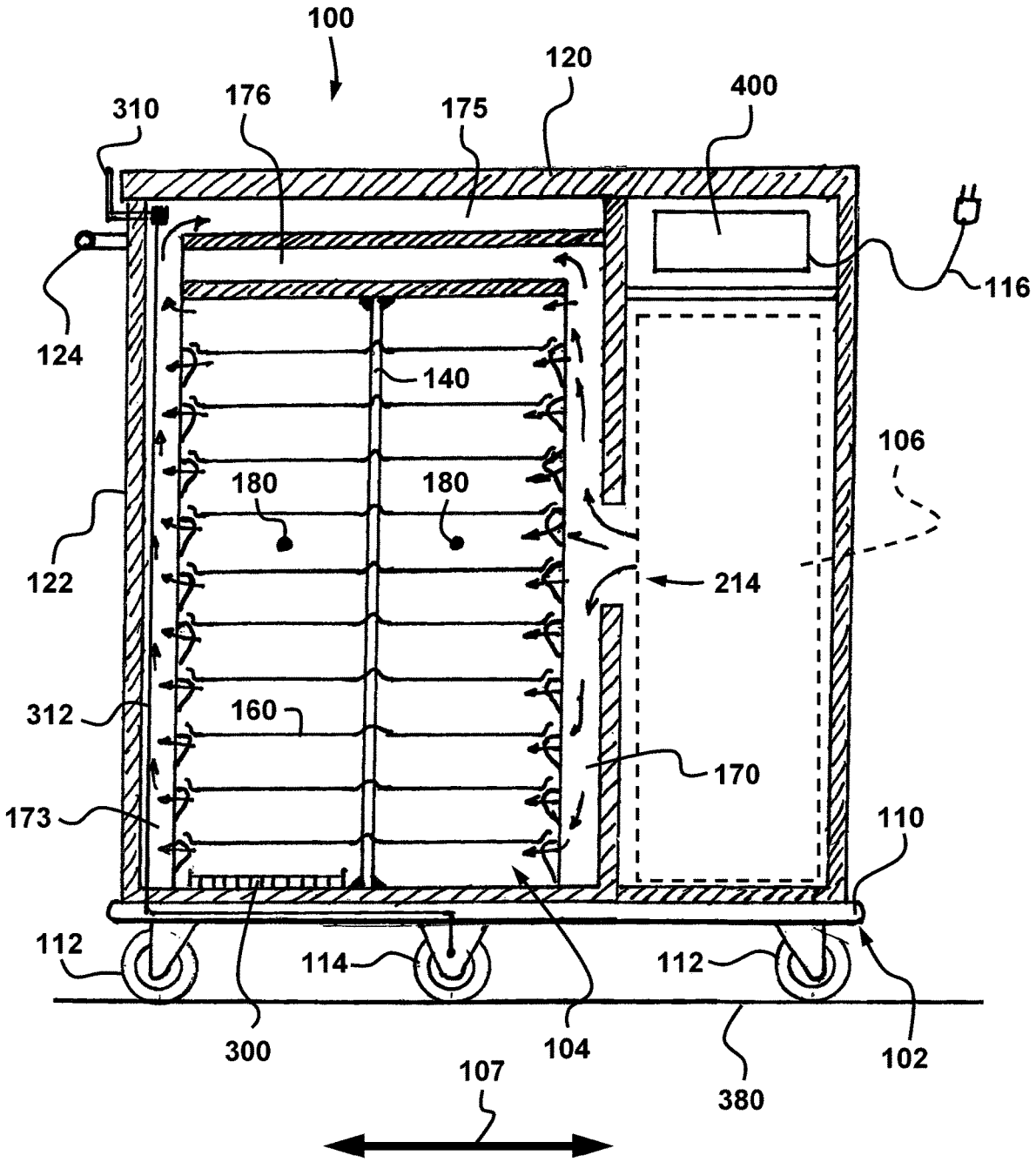
FIG. 8 is a longitudinal cross-sectional view of the housing in the system of FIG. 1.

The heating/cooling unit 106 in the example of FIGS. 1 and 2 is a device capable of supplying thermally regulated air to be circulated into the housing 104. In the illustrated example, the heating/cooling unit 106 can generate both hot and cold air flows. This heating/cooling unit 106 can be constructed as a self-contained machine or cartridge that can be easily repaired or replaced when needed. The heating/cooling unit 106 can be plugged into an electrical power source when parked, for instance, using a power cord 116 as schematically depicted in FIG. 8. It can also include or be otherwise connected to another energy source, such as one or more batteries (not shown) designed to keep at least some of the components running when the power cord 116 is unplugged, for instance when the food tray delivery cart 108 is being repositioned or if no external power supply is otherwise available or used at a given location. Other configurations and arrangements are possible. Among other things, the heating/cooling unit 106 can be designed differently, for instance not as a self-contained machine or cartridge. A heating/cooling unit does not necessarily need to be present when a system 100 is manufactured and sold. The term "heating/cooling" also has a generic meaning and does not necessarily suggest that the same unit must do both. For instance, heat could be provided using by a plurality of heat-generating elements, such as electric heating coils, located at multiple locations within the housing 104 or even on the food trays 160 themselves, with only cooled air coming from the heating/cooling unit 106. This, however, may significantly increase the complexity of the implementation and/or the manufacturing costs of the food trays. Some implementations could also include two separate machines mounted on the same food tray delivery cart 108, one for heating and the other for cooling, and at least one of them could even be designed for doing both functions. Others can include one or more fluid circuits other than air to provide heat and/or to retrieve heat through heat exchangers positioned inside the housing 104 or elsewhere. Some implementations can use more than one method to provide and/or to retrieve heat for redundancy. One or more batteries with a sufficient capacity for sustaining autonomous operation of the heating/cooling unit 106 over at least a complete cycle could be provided on the food tray delivery cart 108. Other sources of energy can be used. Other variants are possible as well.

Figure 7A:
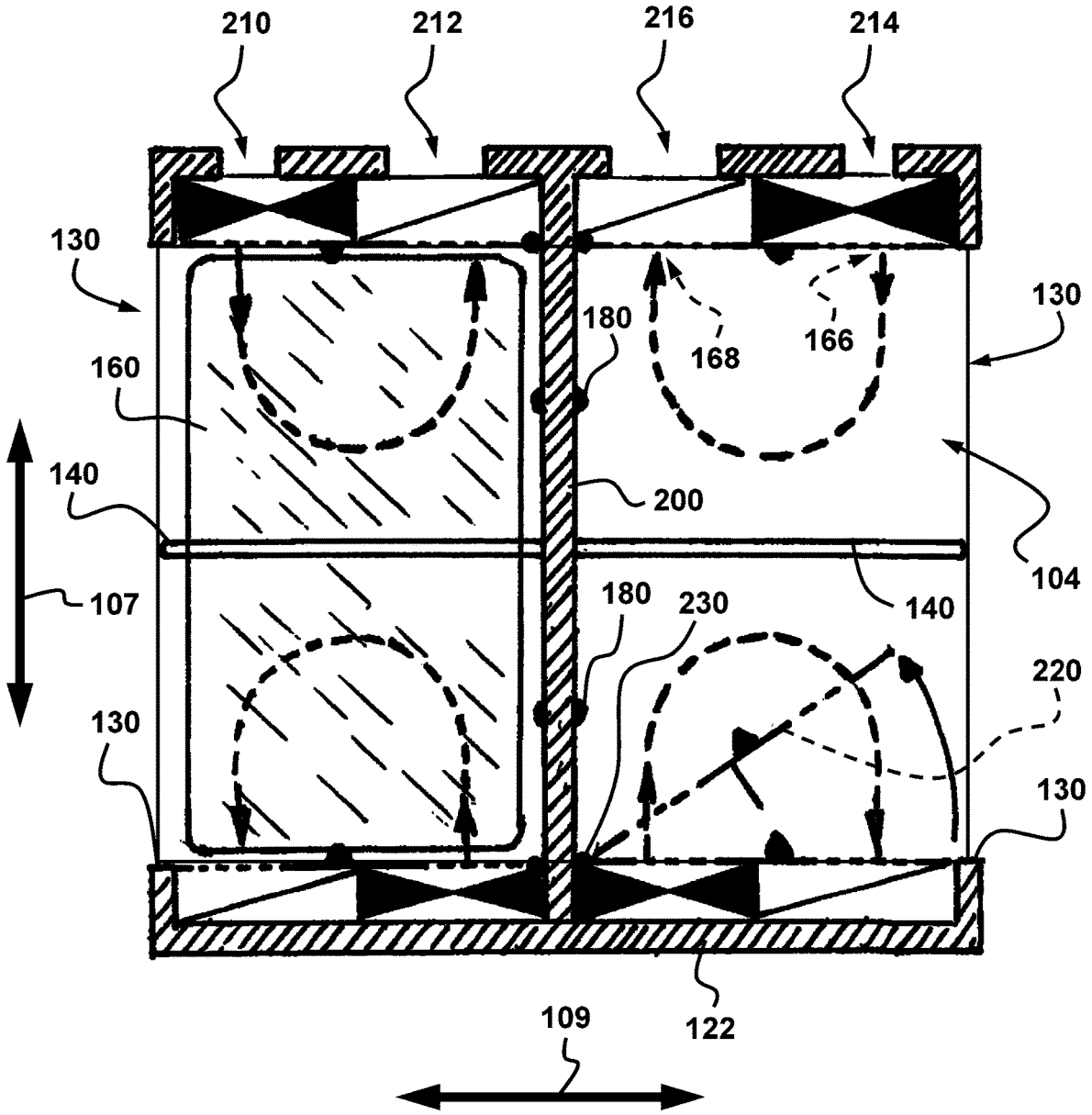
FIG. 7A is a cross-sectional plan view of the housing in the system of FIG. 1.
Figure 7B:
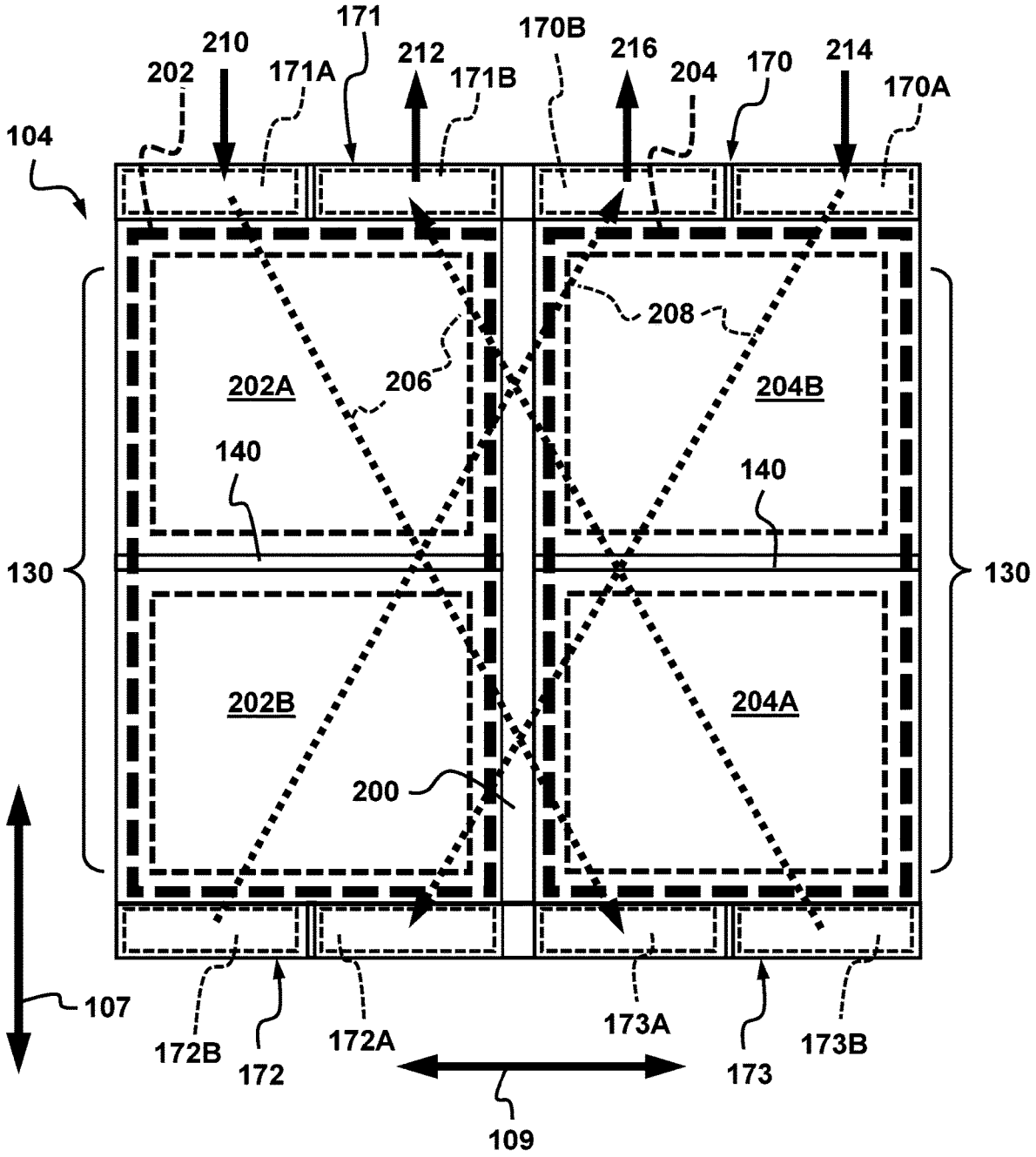
FIG. 7B is a schematic representation of the internal layout inside the housing shown in FIG. 7A.

The housing 104 of the illustrated example includes structural members to create a framework or the like in which are provided separate first and second chambers 202, 204 (see FIG. 7B). Each chamber 202, 204 has an enclosed internal space accessed through a respective one among two opposite lateral openings 130 provided on the housing 104. The housing 104 can also include an outer shell 118 surrounding at least a portion of its framework, as shown for instance in FIGS. 1 and 2. This outer shell 118 includes, among other things, a top panel 120 located above the housing 104 and the heating/cooling unit 106. This top panel 120 can be designed to provide a rectangular and horizontal flat upper surface to temporally store items or for other useful purposes. The outer shell 118 can also include a rear panel 122 having a flat vertical outer surface to which a driving bar or handle 124 can be attached. The handle 124 can be useful to facilitate manual handling of the food tray delivery cart 108 by an attendant. The handle 124 can include a horizontal rod that is attached to the rear panel 122 through a pair of spaced-apart brackets maintaining the horizontal rod in a position where it extends parallel to and at a short distance from the rear panel 122. The rear panel 122 can include a curved vertical edge on each side, as shown. The top panel 120, the rear panel 122, the handle 124 as well as other structural components or parts can be made of stainless steel or the like. Other configurations and arrangements are possible. Among other things, the handle 124 can be designed and/or attached differently, or even be omitted in some implementations. While the food tray delivery cart 108 of the illustrated example is designed to be pushed or pulled by hand, some implementations can include a motorized arrangement to facilitate the handling. The handle 124 can be located at the front of a food tray delivery cart. The rear panel 122, including its vertical edges, can be designed differently in other implementations. The outer shell 118 can be designed differently or even be omitted in some implementations. Other materials can be used besides stainless steel or the like. Other variants are possible as well.

The system 100 can also include a protective casing 136 to cover the front and lateral sides of the heating/cooling unit 106, as shown. This protective casing 136 can include a door 138, for instance a pivotable door, on at least one of the lateral sides. A door can also be provided on the opposite lateral side. The protective casing 136 can be made easily removable to facilitate the access to the heating/cooling unit 106 for maintenance. Other configurations and arrangements are possible. Among other things, the protective casing 136 can be designed differently, for instance having a different kind of door or even without any door. It can also be entirely omitted in some implementations. Other variants are possible as well.

Figure 3:
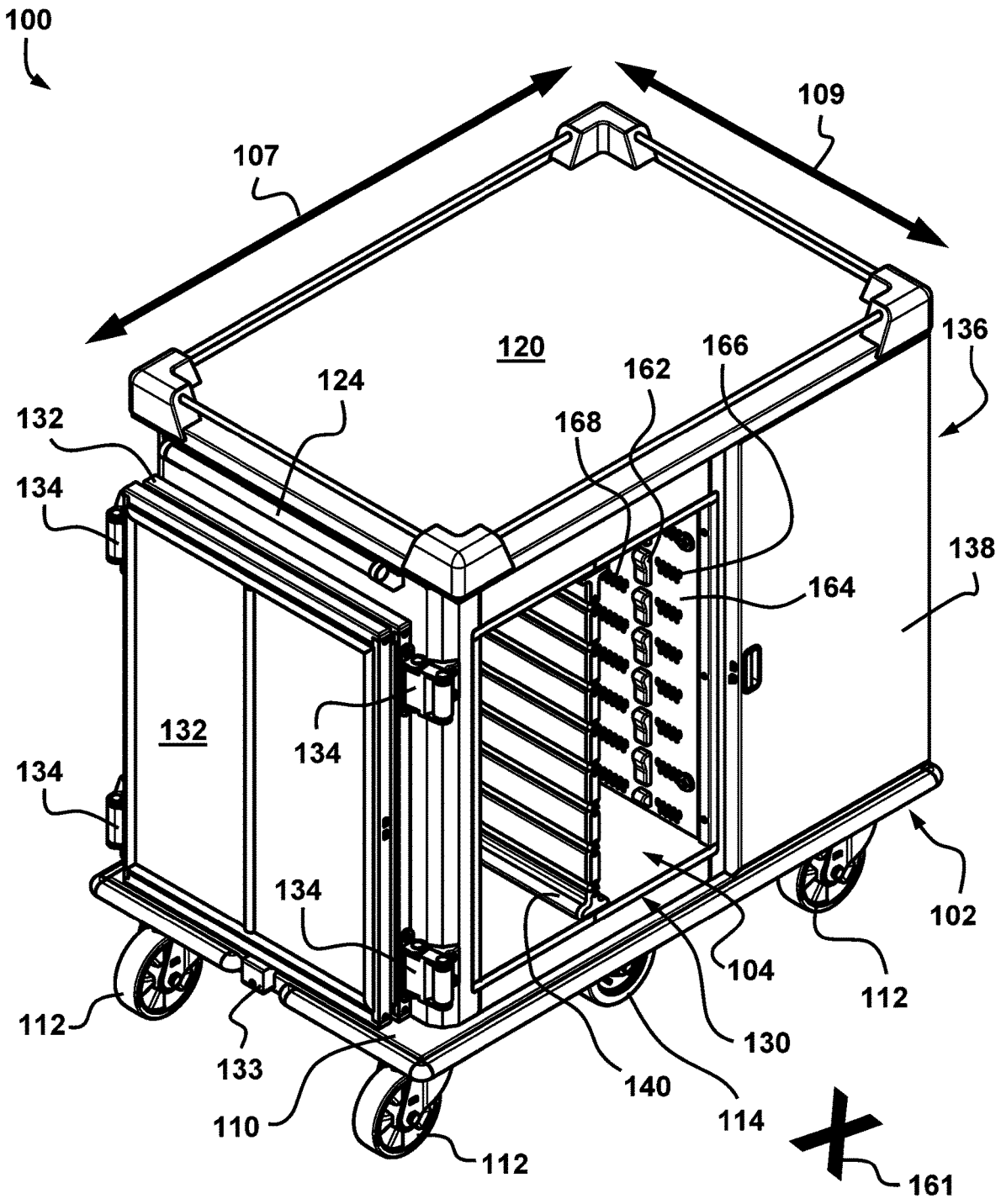
FIG. 3 is a view similar to FIG. 2, but where the lateral doors are open.
Figure 4:
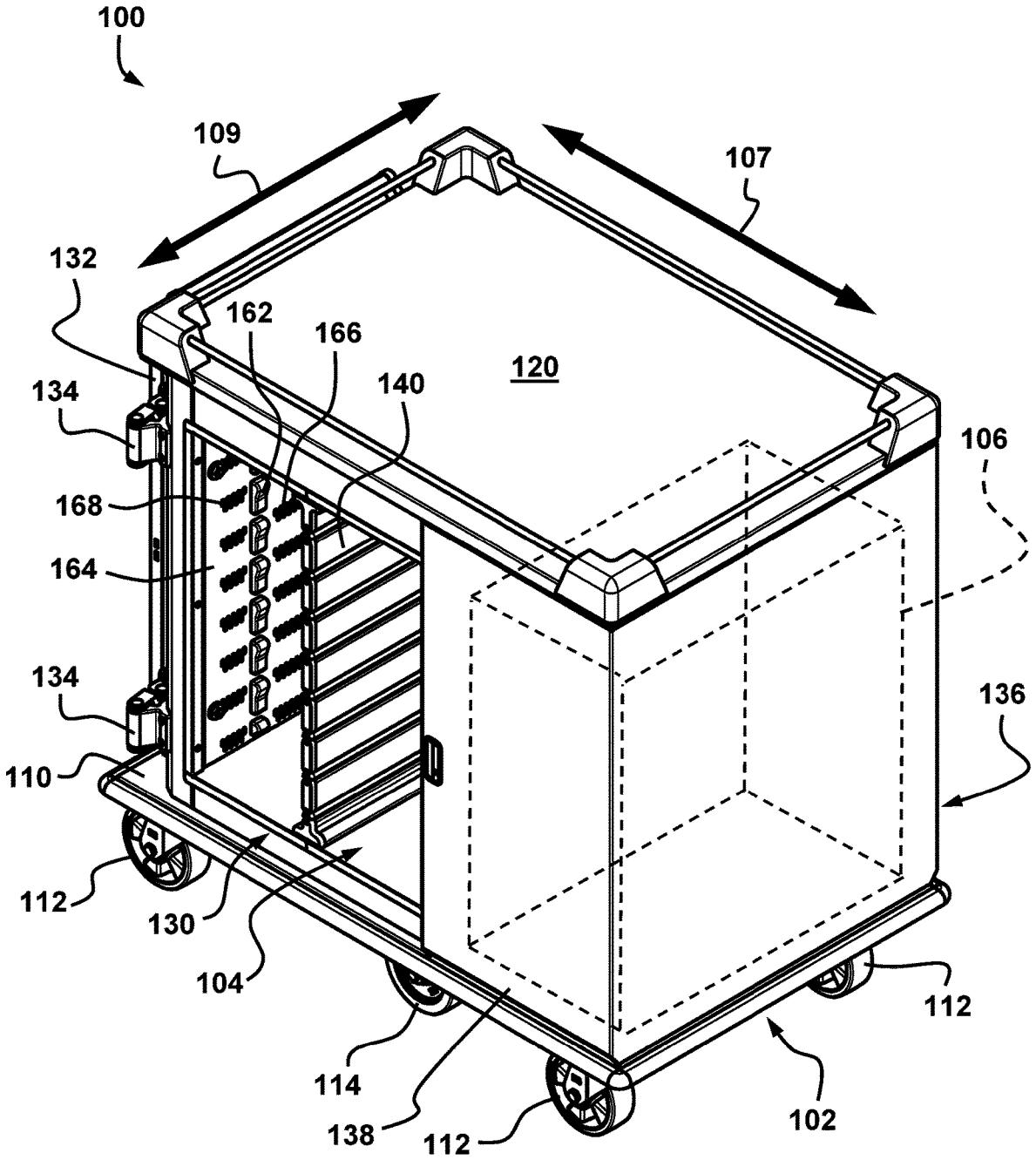
FIG. 4 is a front isometric view of the system as shown in FIG. 3.

The housing 104 of the illustrated example includes two lateral doors 132, one for each one among the two opposite lateral openings 130. Each lateral door 132 is provided to selectively open and close the corresponding lateral opening 130. Both lateral doors 132 are in a closed position in FIGS. 1 and 2. FIG. 3 is a view similar to FIG. 2, but where the lateral doors 132 are open. FIG. 4 is a front isometric view of the system 100 as shown in FIG. 3. The internal space within each of the chambers 202, 204 is said to be enclosed because it becomes a substantially confined space once its corresponding lateral door 132 is in a fully closed position.

Each lateral door 132 can include structural members covered by flat panels on the exterior and interior faces. These flat panels and the main structural members can be made of stainless steel or the like. Each lateral door 132 can also include an internal thermal insulation layer to mitigate heat conduction and increase the overall energy efficiency. The thermal insulation layer can also be desirable to mitigate water condensation on the exterior surfaces under certain conditions. Other configurations and arrangements are possible. Among other things, the lateral doors 132 can be designed differently and/or be made of other materials or combination of materials. The two lateral doors 132 are substantially mirror symmetrical in the illustrated example. However, they do not necessarily need to be mirror symmetrical or otherwise similar in all implementations. At least one of the lateral doors 132 can be in the form of two or more independent or semi-independent subpanels or subsections instead of being constructed as a single unit or section. Other variants are possible as well.

The inner periphery of each lateral door 132 can include one or more gaskets or other features to seal the perimeter around each lateral opening 130. They can also improve the thermal insulation. Gaskets or other features can also be provided or even only be provided on the periphery of each lateral opening 130 created by the housing 104. Other configurations and arrangements are possible. Among other things, the periphery of the lateral openings 130 and/or of the lateral doors 132 does not necessarily need to include gaskets or other features, and these sealing arrangements can be omitted in some implementations. Other variants are possible as well.

Each of the lateral doors 132 can be pivotally attached to the framework of the housing 104, as shown. In the illustrated example, each lateral door 132 is supported by a corresponding pair of spaced-apart double action hinges 134 attached directly to the rear panel 122. Both of these lateral doors 132 open towards the rear, and they can be folded back against the rear panel 122, even when both are fully open simultaneously, regardless of the order. The bottom base panel 110 can be configured to extend far enough towards the rear so that the lateral doors 132 remain within the outer periphery of the bottom base panel 110 when they are folded back against the rear panel 122, as shown in FIGS. 3 and 4. These lateral doors 132 are generally parallel to the longitudinal axis 107 when they are closed, and are generally parallel to the transversal axis 109 when they are fully open. Other configurations and arrangements are possible. Among other things, the lateral openings 130 and the corresponding lateral doors 132 can be designed and shaped differently compared to what is shown and/or described herein. The number, position, and kind of hinges 134 can also be different, and the hinges can be omitted in some implementations. For instance, one or both lateral doors 132 could be designed to slide horizontally or vertically, or be tambour doors or the like. Other kinds of doors are possible. While having the lateral doors 132 within the outer periphery of the bottom base panel 110 when folded back against the rear panel 122 can be desirable for a number of reasons, such as mitigating the risks of damaging the lateral doors 132 due to an impact with another object or structure, this feature can be omitted in some implementations. The lateral doors 132 can be mounted or otherwise attached to the bottom base panel 110 in some implementations. Other variants are possible as well.

The bottom base panel 110 can include a door catch 133 or the like to hold the lateral doors 132 when they are in their fully open position, as shown for instance in FIGS. 2 and 3. Other configurations and arrangements are possible. Among other things, the door catch 133 can be positioned and/or designed differently in some implementations. It can also be omitted in others. Other variants are possible as well.

Figure 23:
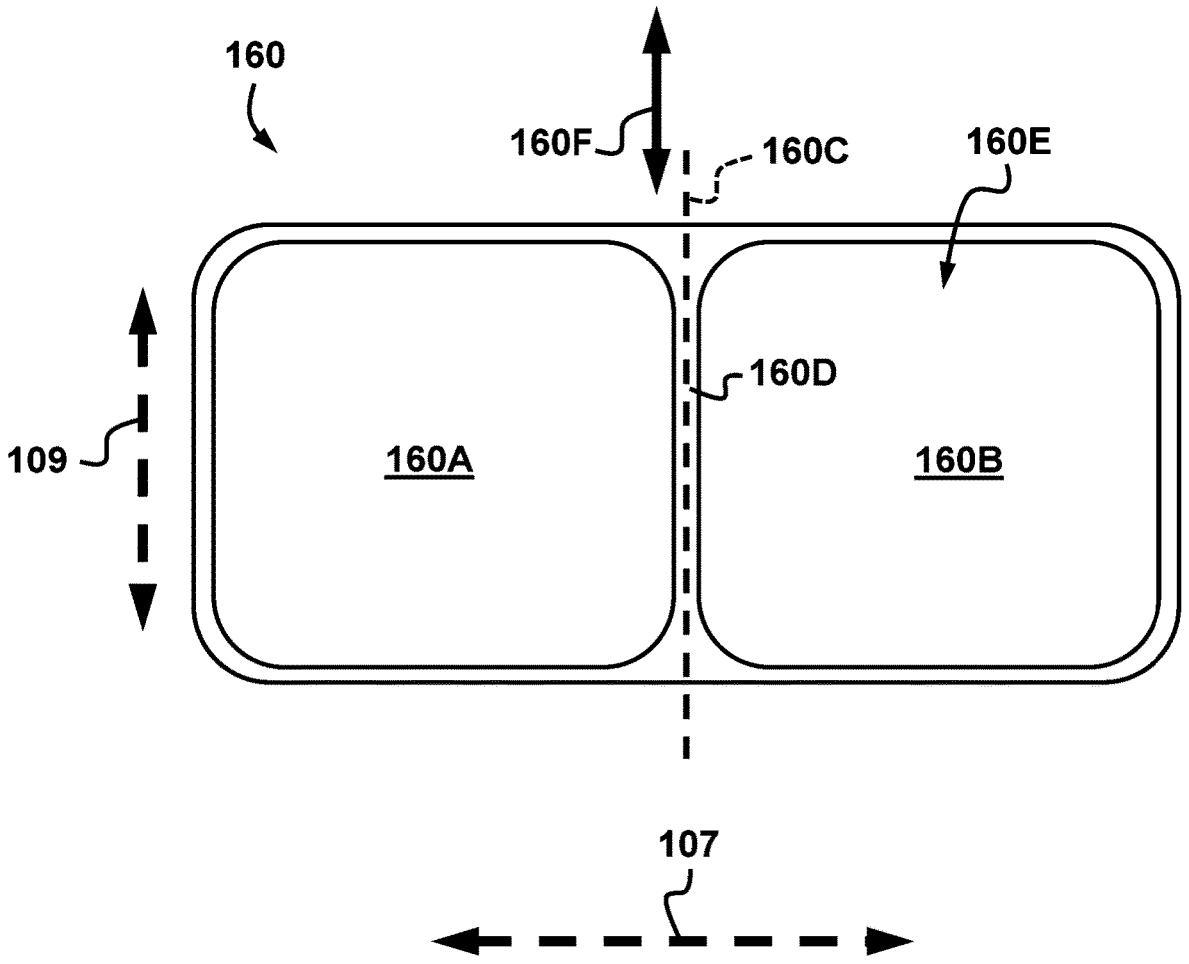
FIG. 23 is a schematic top view of an example of a generic food tray.

A food tray, in the present context, can be broadly defined as an article designed to receive a combination of hot and cold food products. FIG. 23 is a schematic top view of an example of a generic food tray 160. This illustration is very simplified and is only for the sake of explanation. The food tray 160 includes a hot food products area 160A and a cold food products area 160B. This configuration is desirable to allow hot food products to be heated at the appropriate moment before the mealtime while keeping the cold food products at a lower temperature. The system 100 is designed to provide heat to the hot food products before serving the meals without having to access the food trays. Hot and cold food products are put into corresponding compartments during the assembly of the food trays 160. This way, heat can be provided at the appropriate time to increase the temperature of the food products placed in the hot food products area 160A on the food trays 160. Food trays 160, when viewed from above, often have a generally rectangular shape with rounded corners on their outer periphery, as shown. They are also often made of a monolithic piece of a heat-resistant material, for instance a plastic material. Other configurations and arrangements are possible. Among other things, the food trays can be designed differently and/or made using another kind of material or a combination of different materials in some implementations. Other variants are possible as well.

It should be noted at this point that the terms "hot" and "cold" must be understood in the context in which they are presented. They are used primarily to distinguish between the food products that will eventually be heated on the food trays just before serving the meals from those that are not, among other things. These terms are not used, for instance, to suggest that the food products must remain constantly at different temperatures once the food trays are assembled. The term "hot" has a broad meaning and does not necessarily suggest a very high temperature or something more than warm. The hot food products, or at least some of them, may even be cold when the food trays are assembled. The term "cold" also has a broad meaning and does not necessarily suggest a very cold temperature or even a freezing temperature. The cold food products can sometimes be served at room temperature (for instance about 20° C.), but it is also possible to have hot food products served at room temperature while the cold food products are at a cold temperature. The hot food products will generally be hotter than the cold food products when the meals are served, but not necessarily all the time. In particular, because the food trays can be assembled and placed into the housing of a food tray delivery cart many hours in advance, sometimes even days in advance, the entire content of the housing can be kept at a refrigerated storage temperature (for instance about 4° C.) for a certain time and the hot food products will generally be heated only a short time before serving the meals. The hot and cold food products on the food trays can thus be at the same or substantially at the same temperature for a given period of time when stored inside a food tray delivery cart.

These two areas 160A, 160B of the food trays 160 can have similar sizes, as shown, but can also have dissimilar sizes in some implementations. In FIG. 23, the transversal demarcation line 160C between the two food products areas 160A, 160B is at the geometric center, and this demarcation line 160C is generally substantially parallel to the short axis of the food tray 160. It can be located along the top of a continuous and substantially linear ridge 160D extending from one edge to the other on the upper surface 160E of the food tray 160, as shown (see for instance FIG. 14). The demarcation line 160C can also generally be parallel to a loading/unloading direction 160F, as shown. This loading/unloading direction 160F is substantially horizontal and corresponds to the movement of the food tray 160 when inserted or retrieved from the food tray delivery cart 108. Other configurations and arrangements are possible. Among other things, the food trays 160 can be designed differently in some implementations. Other variants are possible as well.

A food tray 160 can also hold dishes, such as plates, bowls, cups, glasses, etc., on which the food products are placed. However, in institutions where meals must be served to a multiple of persons, at least some of the food products can be put directly into corresponding individual compartments provided on the upper surface 160E of each food tray 160. These individual compartments can be delimited by ridges or other features provided in one or both food products areas 160A, 160B on the food trays 160. Some tableware, for instance dishes, utensils, lids, or any other kind of kitchenware, can be placed onto the upper surface 160E of the food trays 160 together with food products long before the meals are served. At least some can be already present when the food trays 160 are loaded at the food tray assembly station. Any tableware will thus be cooled and/or heated together with the other food products. Further, the food products on a food tray can include hot and/or cold beverages. For instance, a cup containing water can be placed on the hot food products area 160A and this water will then be heated along with the other hot food products prior to serving the meal to a person.

The system 100 also includes a tray supporting arrangement inside each chamber 202, 204 to allow a number of food trays to be stacked at multiple possible levels. Each food tray is removably inserted (i.e., loaded) into one of the chambers 202, 204 through the corresponding lateral opening 130, and each food tray will subsequently be retrieved (i.e., unloaded) through the same corresponding lateral opening 130. The tray supporting arrangement inside each chamber 202, 204 has a plurality of vertically spaced stacking positions. Each stacking position corresponding to a stowage space for receiving one food tray 160. The food trays 160 are vertically spaced apart from one another and the vertical distance between two immediately adjacent stacking positions is selected so that the food products placed on the food trays 160, including any tableware, will remain at least slightly below the underside of a food tray 160 to be positioned, or that is already present, within the stowage space immediately above. The food trays 160 will generally remain at the horizontal from the moment food products are placed thereon at a food tray assembly station until they are received at a cleaning station after the mealtime. The food trays 160 are horizontally slid into the stowage space at a corresponding one of the stacking positions. The stowage position at the top is closed by the ceiling panel inside the corresponding chamber 202, 204. The number of food trays that can be stacked will often depend on the minimum vertical spacing required between the food trays, and also the maximum height that can still be within the reach of most attendants when they stand on the floor next to a food tray delivery cart 108.

Each tray supporting arrangement can include individual supports 162 or holders affixed on the corresponding inner surfaces inside the chamber 202, 204, as shown in the illustrated example. Each support 162 engages the bottom surface under the outer peripheral rim and a number of spaced-apart supports 162 are provided at each stacking position to create a rack, track or shelf on which the food tray 160 can be pushed or pulled while being guided and supported. Other configurations and arrangements are possible. Among other things, the supports can be replaced by other elements or features, and/or the tray supporting arrangements can be configured completely differently in some implementations. Other variants are possible as well.

Each chamber 202, 204 of the illustrated system 100 includes a vertically extending thermal barrier 140. FIGS. 3 and 4 show the thermal barrier 140 that is provided within one of the chambers 202, 204 in the illustrated example to create a partition wall separating the hot and cold food products areas 160A, 160B on the food trays 160. An identical thermal barrier is also provided inside the opposite chamber. Each thermal barrier 140 divides the enclosed internal space within the corresponding chamber 202, 204 into separate vertically extending hot and cold food products sections 202A, 202B, 204A, 204B over substantially the entire height thereof. This division is made along the demarcation line 160C on the food trays 160. It creates a total of four vertical sections or columns within the housing 104. The first chamber 202 includes a hot and cold food products section 202A, and a cold food products section 202B. The second chamber 204 includes a hot and cold food products section 204A, and a cold food products section 204B.

Each thermal barrier 140 can include a plurality of vertically spaced-apart horizontal slots, and each slot corresponds to a stacking position where one of the food trays 160 can be inserted. The thermal barrier 140 can also provide additional support for the food trays 160. Other configurations and arrangements are possible. Among other things, although the illustrated thermal barrier 140 is shown as extending about the center of the food trays 160 in the illustrated example, the hot and cold food products areas 160A, 160B on the food trays 160 can have different sized and the thermal barrier 140 will then not be positioned at the geometric center. Other variants are possible as well.

Each thermal barrier 140 in the example extends perpendicularly with reference to the lateral opening 130 across the entire width of the corresponding chamber 202, 204. The thermal barrier 140 substantially prevent air circulating in the airspace over the hot food products area 160A to reach the airspace over the cold food products area 160B of this food tray 160, and vice versa. Each thermal barrier 140 includes seals or other features designed to close any one of the clearance spaces when no food tray is present at a given stacking position. In use, each food tray 160 will extend across the entire width and depth of the corresponding chamber 202, 204. The food trays 160 fit relatively tightly within the interior of each chamber 202, 204 and, once the lateral doors 132 are fully closed, the periphery of the food trays 160 closely engage the surrounding wall surfaces to minimize or even prevent air from reaching the spaces on the opposite side of the thermal barrier 140. The food trays 160 themselves create subdivisions within each section. Other configurations and arrangements are possible.

The system 100 is designed, among other things, so that the same food tray orientation is used during the loading process through both opposite lateral openings. In other words, the orientation of the hot and cold food products areas 160A, 160B on the food trays 160 will remain constant for an attendant standing on the floor next to the system 100, when the system 100 is repositioned the other way around. This standpoint on the floor is schematically depicted in FIG. 3 at 161. Thus, the food tray orientation will not have to be changed depending on which lateral opening 130 is being used. This can significantly mitigate the risks of having misoriented food trays and the consequences if such a mistake remains undetected until the misplaced food trays are retrieved from the housing to serve the meals, among other things.

In the illustrated example, when viewed from above, the hot food products section 202A of the first chamber 202 and the hot food products section 204A of the second chamber 204 are diametrically opposite to one another, and the cold food products section 202B of the first chamber 202 and the cold food products section 204B of the second chamber 204 are diametrically opposite to one another. This checked pattern layout can be seen, among other things, in FIG. 7B.

Figure 5:
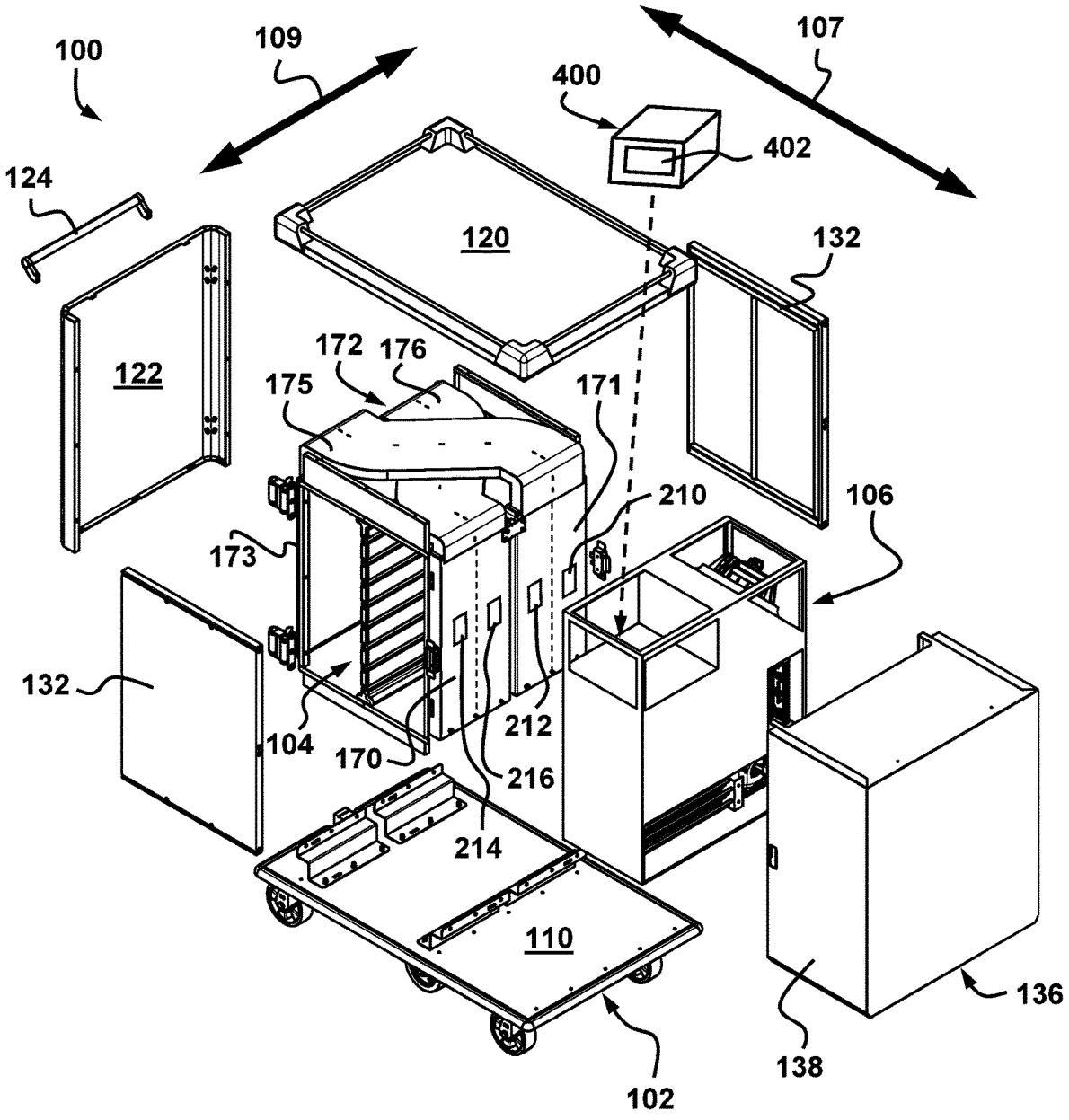
FIG. 5 is a front isometric and partially exploded view of the system of FIG. 1.
Figure 6:
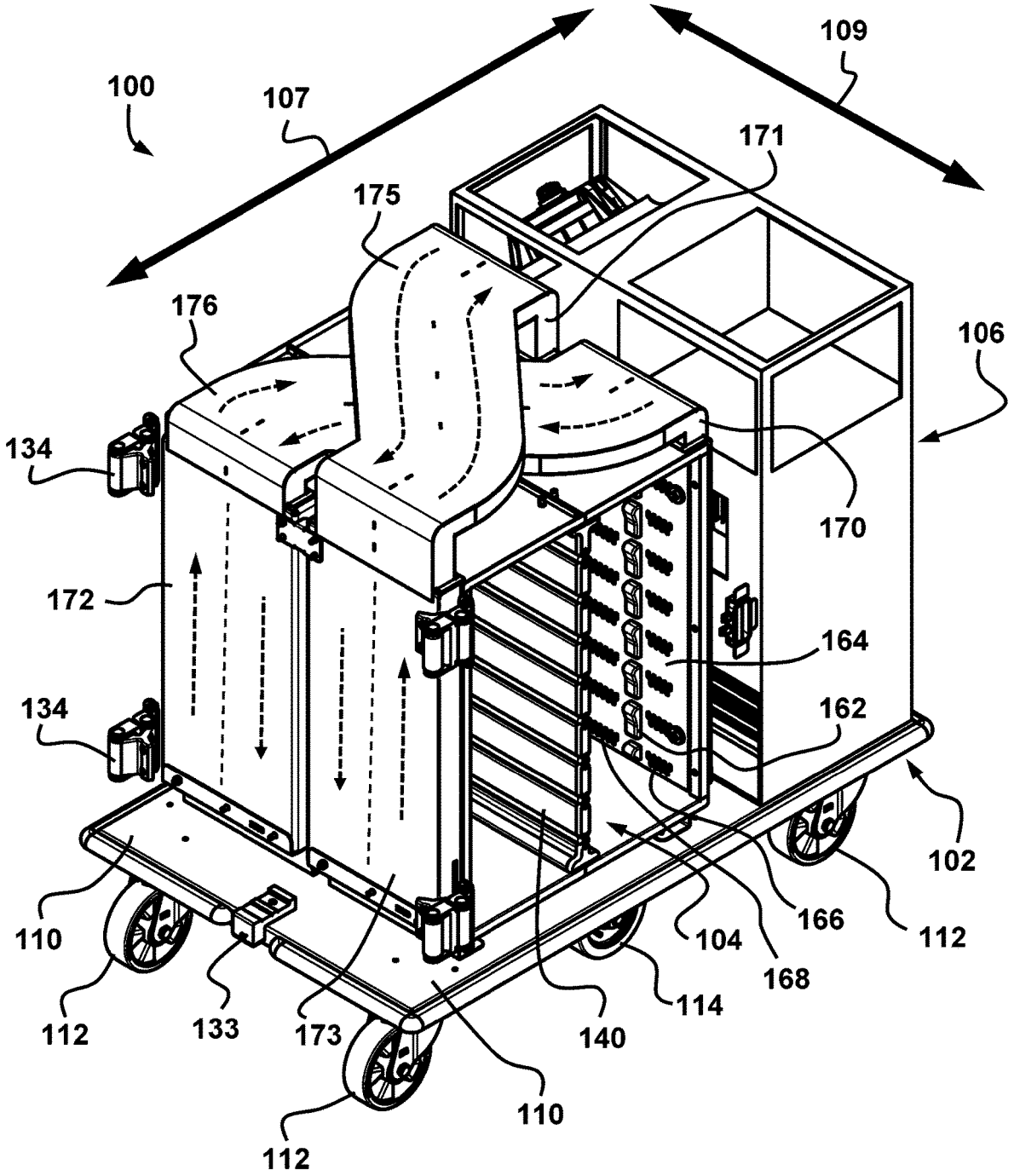
FIG. 6 is a rear isometric view of the system of FIG. 1 where the lateral doors, the outer panels and other components were removed for the sake of illustration.

FIG. 5 is a front isometric and partially exploded view of the system 100 of FIG. 1. FIG. 6 is a rear isometric view of the system 100 of FIG. 1 where the lateral doors 132, the outer panels and other components, such as the control module 400, were removed for the sake of illustration.

The system 100 can include a control module 400 provided on the food tray delivery cart 108, as shown for instance in FIG. 5. This control module 400 can be located in a dedicate space on a top lateral space provided on the heating/cooling unit 106, as shown. The control module 400 can include, for instance, hardware and software components to control and monitor the heating/cooling unit 106 and/or other features. It can also include a display screen 402, visible for instance when the door 138 is open, directly on one side thereof. This display screen 402 can be a touch screen through which an attendant can control the various functions and subsystems, and also access different information. The control module 400 could also include switches (not shown) or the like. If desired, the control module 400 can be configured to receive signals from various sensors, for instance temperature and/or humidity sensors 180, to name just a few, located inside the chambers 202, 204. The control module 400 in the illustrated example can be configured to constantly receive data from temperature and/or humidity sensors 180 located inside the chambers 202, 204 or elsewhere. This can be useful to detect a potential or actual problem, and to notify an attendant or someone else if necessary. For instance, data coming from one or more temperature and/or humidity sensors 180 during any one of the stages of operation can be collected and recorded and/or automatically transmitted to an external system in case something will be discovered at a later date. Data from the temperature and/or humidity sensors 180 can also be useful even when no food tray is present, such as during a cleaning operation. The control module 400 can include a wireless antenna or another kind of communication system to establish a unidirectional or bidirectional electronic link with one or more remote computer systems or the like. Other configurations and arrangements are possible. Among other things, although the control module 400 is depicted in FIG. 5 as an independent piece of equipment, for instance a general-purpose computer or the like that can be replaced by another one when a repair or an upgrade is necessary, the control module 400 can be made integral, at least in part, with another one of the components of the system 100, for instance the housing 104 and/or the heating/cooling unit 106. It can be positioned elsewhere. The control module 400 may not necessarily include an integrated display screen 402 in all implementations. Still, some implementations can be designed to operate using only manually operated mechanical switches or the like, thus without having any control module 400 or an equivalent. Other variants are possible as well.

Once the mealtime is over, the soiled food trays are often simply inserted back into the housing 104 to be transported to another location, for instance to a tray cleaning station where the soiled food trays will be removed from the housing 104, emptied and thoroughly cleaned. The interior of the housing 104 must then generally be cleaned afterwards because some of the surfaces could have been in contact with some food products at some point. A cleaning operation with an increased degree or level of thoroughness and completeness can also be necessary from time to time, and the procedures may require for instance sanitizing surfaces inside air conduits or ducts, among other things. In general, a routine cleaning operation and the more extensive ones can involve using a high-pressure hot water spray or jet to remove any food residues and other possible contaminants from the surfaces. The temperature and/or humidity sensors 180 can be configured and disposed to detect the sudden and brief increase of the temperature and/or humidity level occurring when they are in contact with a hot water spray during cleaning. The control module 400 can then be programmed to monitor and relay data obtained from these signals or, if applicable, their absence. For instance, not receiving a signal from one or more of the sensors could indicate that at least some of the surfaces inside the chambers 202, 204 were not cleaned for some reason, thus that the cleaning operation is incomplete. Other configurations and arrangements are possible.

The various sections within the chambers 202, 204 inside the housing 104 can receive air coming from the heating/cooling unit 106 through an air passage arrangement. This air passage arrangement is provided to form a hot food products air circuit 206 and a cold food products air circuit 208. These two air circuits 206, 208 are separate from one another. They each extend between an inlet and an outlet without mixing.

FIGS. 5 and 6 show some of the parts of the air passage arrangement in the illustrated example. This air passage arrangement receives air from the heating/cooling unit 106 and returns it afterwards through various inlet and outlet ports 210, 212, 214, 216 located at the front side of the chambers 202, 204 in this example. These ports are only schematically depicted in FIG. 5. The air passage arrangement allows two separate air circuits 206, 208 (see FIG. 7B) to be formed within the housing 104. These first and second air circuits 206, 208 will pass through corresponding conduits provided around the chambers 202, 204 and through air spaces inside the chambers 202, 204, where the air circuits 206, 208 are divided into a plurality of local arc-shaped subbranches. One of these air circuits 206, 208 is associated with one among the hot and cold food products, and the other one is associated with the cold food products. The cross-section areas of the outlet ports 212, 216, through which the outgoing air returns into the heating/cooling unit 106, is often larger than that of the corresponding inlet ports 210, 212. Other configurations and arrangements are possible. Among other things, the ports do not necessarily need to have a rectangular shape and/or to be something that is an opening made through a panel, a wall or another element. The term "port" and other related terms are, in general, simply referring to one end of an air circuit. They are the locations where air is supplied and returned after passing inside the housing 104, for instance the junction between air conduits around the housing 104 and air conduits or other kinds of passageways inside the heating/cooling unit 106. Other variants are possible as well.

It should be noted that the first and second air circuits 206, 208 will now be referred to hereafter as the "hot food products" air circuit 206 and the "cold food products" air circuit 208. This is only for the sake of simplicity. Other configurations and arrangements are possible. Among other things, in other implementations, the first air circuit 206 can be the "cold" air circuit and the second air circuit 208 would then be the "hot" air circuit compared to what is shown in the figures. Other variants are possible as well.

In general, air inside the system 100 circulates in a closed loop. In other words, once the lateral doors 132 are closed, the air content will remain the same until at least one of these lateral door 132 is open. This is often desirable to mitigate the release of food odors and/or to increase the energy efficiency. Other configurations and arrangements are possible. Among other things, the air inside the system 100 may not necessarily circulate or always circulate in a closed loop in all implementations. Other variants are possible as well.

Air from the hot food products air circuit 206 will circulate over the hot food products areas 160A on the food trays 160 while air from the cold food products air circuit 208 circulates over their cold food products areas 160B before the meals are served. This is what is referred to hereafter as the food heating mode. Before the food heating mode is taking place, however, it is often necessary to keep all food products, hot or cold, at a refrigerated temperature (for instance of about 4° C.). This is referred to hereafter as the food storage mode. The temperature of the air circulating in the hot food products air circuit 206 and the temperature of the air circulating in the cold food products air circuit 208 can thus be the same or substantially the same during the food storage mode. Hence, the term "hot" does not require the air be hot or hotter than the "cold" air at any given time. Air flowing along the two air circuits 206, 208 can be mixed inside the heating/cooling unit 106 during the food storage mode. The two air circuits 206, 208 remain independent from one another inside the housing 104 during the food storage mode and when the food heating mode is in progress, air returning into the heating/cooling unit 106 from the two air circuits 206, 208 will not be mixed to save energy. Other configurations and arrangements are possible. Among other things, air from the two air circuits 206, 208 does not necessarily need to be mixed during the food storage mode in all implementations. Some implementations can be designed without a food storage mode, for instance when the meals are always served immediately once the food trays 160 are loaded inside the housing 104, or for other reasons, such as when the whole system 100 can be stored inside a refrigerated space. Other variants are possible as well.

The air passage arrangement around the chambers 202, 204 can include four vertical double air ducts 170, 171, 172, 173 and two double horizontal air ducts 175, 176, as shown in the illustrated example. FIGS. 5 and 6 show that in the illustrated example, the two horizontal double air ducts 175, 176 are located at the top of the chambers 202, 204 and, when viewed from above, have an X-shaped configuration or layout in the illustrated example. The horizontal double air ducts 175, 176 can include outer walls made of or covered with a thermally insulating material, for instance in the overlapping portions or along their entire length. Each of these horizontal and/or vertical double air ducts can be formed by a corresponding pair of air conduits that are substantially adjacent and parallel to one another in which air flows in opposite or counterflow directions or paths, one being an incoming flow path and the other being an outgoing flow path. These two air conduits can have, for instance, a common intervening separator wall extending along their entire length. Other configurations and arrangements are possible. Among other things, the air passage arrangement can be designed and/or positioned differently in other implementations, including without having at least one among the horizontal and/or vertical double air duct. For instance, some of the conduits can be detached from one another, or positioned away from one another. Some of the horizontal and/or vertical conduits may not be adjacent and parallel to one another, either over their entire length or a portion thereof. Other variants are possible as well.

It should be noted that in the illustrated example, as depicted in FIG. 7B, the vertical air duct 170 has an incoming air conduit 170A and an outgoing air conduit 170B, the vertical air duct 171 has an incoming air conduit 171A and an outgoing air conduit 171B, the vertical air duct 172 has an incoming air conduit 172A and an outgoing air conduit 172B, and the vertical air duct 173 has an incoming air conduit 173A and an outgoing air conduit 173B. Other configurations and arrangements are possible. Among other things, the configuration can be different in other implementations. Other variants are possible as well.

The top end of each vertical air duct 170, 171, 172, 173 can be attached to a corresponding end of one of the horizontal air ducts 175, 176, and their internal air conduits can be designed to hermetically fit end-to-end, as shown. For instance, in the illustrated example, the two air conduits 170A, 170B are in direct fluid communication with a respective one of the air conduits 172A, 172B located on the diametrically opposite side of the housing 104 through air conduits of the first horizontal double air duct 175. Likewise, the two air conduits 171A, 171B are in direct fluid communication with a respective one of the air conduits 173A, 173B located on the diametrically opposite side of the housing 104 through air conduits of the first horizontal double air duct 175. Other configurations and arrangements are possible. Among other things, one or more of the air ducts or conduits can be designed and/or positioned differently. At least one among the horizontal air ducts 175, 176 can be provided under the housing 104 in some implementations. Others can include one or more horizontal air ducts under the housing 104 in addition to the ones provided at the top and that also have an X-shaped configuration or layout when viewed from above. Other variants are possible as well.

FIG. 7A is a cross-sectional plan view of the housing 104 in the system 100 of FIG. 1. The heating/cooling unit 106 is only semi-schematically depicted and some of the components, for instance the lateral doors 132, were omitted for the sake of simplicity. FIG. 7A shows the interior of the housing 104 has a first 202 and a second chamber 204. These chambers 202, 204 can be separated from one another by an intervening vertically extending partition wall 200, as shown. The partition wall 200 hermetically separates the two chambers 202, 204, and the interior of each chamber 202, 204 can only be accessed through its corresponding lateral opening 130. The two thermal barriers 140 can also be seen. The outer surfaces on each side of the partition wall 200 can be made of stainless steel or the like. However, the interior of the partition wall 200 can be thermally insulated. Other configurations and arrangements are possible. Among other things, the chambers 202, 204 can be in the form of two separately constructed containers or vessels placed inside the housing 104. The back walls of these chambers can also be made larger and even large enough to receive the heating/cooling unit 106 between them in some implementations. Other materials are possible besides stainless steel or the like. Other variants are possible as well.

For the sake of simplicity, the first and second sections within the chamber 202, 204 will now be referred to as hot and cold food products sections since in each chamber 202, 204, the hot food products areas 160A of all food trays 160 placed therein will be in one food products section and their opposite cold food products areas 160B will be in the other. Accordingly, in the first chamber 202 has a hot food products section 202A and a cold food products section 202B, and the second chamber 204 has a hot food products section 204A and a cold food products section 204B.

FIG. 7A shows that there are two sets of inlet and outlet ports for supplying and retrieving air from inside the chambers 202, 204. The first set includes a first inlet port 210 and a first outlet port 212. They are, respectively, the upstream and downstream ends of the hot food products air circuit 206. The second set includes a second inlet port 214 and a second outlet port 216. They are, respectively, the upstream and downstream ends of the cold food products air circuit 208.

FIG. 7A further shows that portions of the air circuits 206, 208 follow a substantially arc-shaped path or loop within each food products section. Air passes over and also above the food products to provide heating or cooling. In some cases, an air flowing under the surface of a food tray 160 can transfer and/or retrieve heat more efficiently than air flowing above. An air flow is nevertheless provided under and also above each food tray 160 since two vertically consecutive food trays 160 within a stack have a common intervening space, except at the topmost and bottommost stacking positions. Accordingly, additional sets of air apertures can be provided in some implementations at the top and/or the bottom of a food products section. Other variants are possible as well.

FIG. 7B is a schematic representation of the internal layout inside the housing 104 shown in FIG. 7A. This view is provided only to depict the position of the various components of this example.

Each vertical double air duct 170, 171, 172, 173 can include a corresponding air diffuser panel 164 extending along its inner side. Each of these panels 164 include sets of air apertures 166, 168 for circulating air in the spaces above and under the food trays 160. In use, air enters the space between two food trays 160 through the incoming air apertures 166 and exits through the outgoing air apertures 168. Air that follows the hot food products air circuit 206 can only go over and under the hot food products area 160A on the food trays 160, and air that follows the cold food products air circuit 208 can only go over and under the cold food products area 160B on the food trays 160. There is at least one incoming air aperture 166 and at least one outgoing air aperture 168 for each intervening space between the corresponding food products areas of two superimposed food trays 160 in a given stack. There are also at least one incoming air aperture 166 and at least outgoing air aperture 168 for the airspace immediately above the corresponding food products area 160A, 160B on the food tray 160 located at the top, as well as at least one incoming air aperture 166 and at least one outgoing air aperture 168 for the space immediately under the corresponding food products area 160A, 160B on the food tray 160 located at the bottom of the stack. The number, size and/or shape of the various air apertures 166, 168 can vary depending on where they are located along the corresponding air circuits 206, 208. The dimensions of the air conduits leading to or away from the air apertures 166, 168 can also vary. In general, the internal air supply network is designed so that in each air circuit 206, 208, the flow rate of air passing through its subbranches will be approximately the same, taken into account the pressure drop along the way. For instance, the cross section of the air apertures 166, 168 of a set located very close to the inlet and outlet ports will be smaller or collectively smaller than that of air apertures 166, 168 of a set located at a far end on the opposite site of the housing 104. These principles are well known to those skilled in the art and therefore, they do not need to be discussed further. Other configurations and arrangements are possible.

Air coming out of the incoming air apertures 166 will cool or heat the food products over which it flows, depending on the mode of operation and the corresponding food products area 160A, 160B. With the exception of the incoming air apertures 166 at the topmost location, air will also provide heat or cooling to the underside of every food tray 160. These food trays 160 will conduct heat, either for heating or cooling, so heat transfers can occur on both top and bottom sides. In general, the incoming air apertures 166 are positioned to direct air towards the underside of each food tray 160 and not directly over the food products to prevent or mitigate dehydration, particularly the dehydration of the hot food products during the food heating mode. Providing most of the heat using heat conducted through the thickness of the material of the food trays 160 is generally desirable. Among other things, some food trays 160 may have lids placed over at least a portion of the hot food products and they can disrupt the heat transmission coming from air passing on the upper side.

Ideally, when the food trays 160 are assembled, the hot food products are positioned on the hot food products area 160A so as to evenly distribute the thermal load as much as possible. For instance, a thin slice of meat loaf should not be placed directly on the surface of the food tray 160 next to a scoop of mashed potatoes. The thin slice of meat loaf may receive an excessive amount of heat during the food heating mode while the mashed potatoes are not receiving enough. In this case, during the food tray assembly, the scoop of mashed potatoes can be flattened, and the thin slice of meat loaf can be placed above this layer. In general, hot food products are simply heated or reheated, and are not cooked during the food heating mode.

Sets of incoming and outgoing air apertures 166, 168 can be provided to send air into the spaces over the topmost food trays 160 of the stacks. Some implementations can be configured differently. However, during the food heating mode, having some of the air flowing along the hot food products air circuit 206 going over the hot food products area 160A of the topmost food tray 160 of each stack can be useful to prevent an excessive amount of condensation from building up inside a lid placed over the hot food products or some of the hot food products. Hot food products can receive heat coming from air passing or even impinging on the underside of the hot food products area 160A on the food trays 160. Providing heat in the air space immediately above the hot food products area 160A of the topmost food tray 160 of each stack to bring its air temperature at the same or close to the same air temperature below can mitigate the condensation inside a lid.

It should be noted that the hot food products air circuit 206 and the cold air circuit 208 each include a multitude of subbranches of different lengths. For instance, some of the air passing through the inlet port 210 will go through the closest incoming air aperture or apertures 166 from the inlet port 210, circulate into the corresponding space, and then exit through the outgoing air aperture or apertures 168 before passing through the outlet port 212 located very close. This subbranch is the shortest on this side. In contrast, the air coming from the inlet port 210 will reach the corresponding airspace located at the bottom of the diametrically opposite side only after passing through the corresponding air conduit inside the horizontal air duct 175 at the top and then all the way down before reaching the incoming air aperture or apertures 166 of that airspace. This air will exit the airspace through the corresponding outgoing air aperture or apertures 168, then flow all the way in the opposite direction to reach the outlet port 212. This subbranch is thus very long. There are a multitude of subbranches and a multitude of local air paths within each air circuit 206, 208. Accordingly, each air circuit 206, 208 does not follow a single path but multiple ones. Each air circuit 206, 208 is thus formed by the combination of the multiple subbranches inside the housing 104 and other corresponding air passages within the system 100. Other configurations and arrangements are possible. Among other things, the layout of the various ports 210, 212, 214, 216 can be different in some implementations. Other variants are possible as well.

The air diffuser panels 164 through which the air apertures 166, 168 are provided can be part of air distribution doors 220 that are pivotally mounted inside the housing 104. There are four of these air distribution doors 220 inside the housing 104 of the example in FIG. 1. This feature can greatly facilitate access for cleaning the interior of the chambers 202, 204 and the air conduits on each side. The air distribution doors 220, like other components and panels inside the housing 104, can be made of stainless steel or the like. As known by those skilled in the art, the dimensions of the various air conduits and of the air apertures 166, 168 are generally designed so as to obtain substantially similar airflows in the air spaces receiving air coming from a same air circuit 206, 208. Other configurations and arrangements are possible. Among other things, the air distribution doors 220 could be replaced by other kinds of panels or be designed completely differently, including panels that cannot be pivoted. For instance, some implementations could be designed so that accessing the interior of the conduits is made from the exterior instead of the interior as shown. Other materials could be used instead of stainless steel or the like. Other variants are possible as well.

FIG. 8 is a longitudinal cross-sectional view of the housing 104 in the system 100 of FIG. 1. As can be seen, there are ten food trays 160 in superposition in this illustrated example. There are also ten food trays 160 that can be loaded in the other stack through the opposite side. Other configurations and arrangements are possible. Among other things, the number of food trays 160 can be different on each side. Other variants are possible as well.

FIG. 8 further shows semi-schematically that the system 100 can include a parking brake arrangement to prevent the food tray delivery cart 108 from moving when parked, for instance when food trays are loaded or unloaded, when the heating/cooling unit 106 is plugged into an electric socket, or in any other situation where preventing the food tray delivery cart 108 from moving is warranted. In the illustrated example, the parking brake arrangement includes a manually operated brake lever 310 provided on the rear panel 122 just above the handle 124. The brake lever 310 can be pivoted, for instance over 180 degrees, to selectively activate and release a braking mechanism provided on or built-in into one or more of the wheels under the carriage 102, for instance the two wheels 114 at the center. The pivot mount at the base of the brake lever 310 can be mechanically connected to the wheels 114 through one or more brake cables 312, as shown. Changing the position of the brake lever 310 actuates the braking mechanism of each wheel 114 by pulling or pushing the metallic wire inside the cable or each of the brake cables 312 to engage or release the parking brake. Other configurations and arrangements are also possible. Among other things, the brake lever 310 or any other components of the parking brake arrangement can be designed and/or positioned differently and/or be actuated without using a brake cable. The parking brake arrangement can also be replaced by something else, or even be entirely omitted in some implementations. Others can include a parking brake arrangement that is controlled and operated through an electric or electronic interface or connection. Other variants are possible as well.

Figure 9:
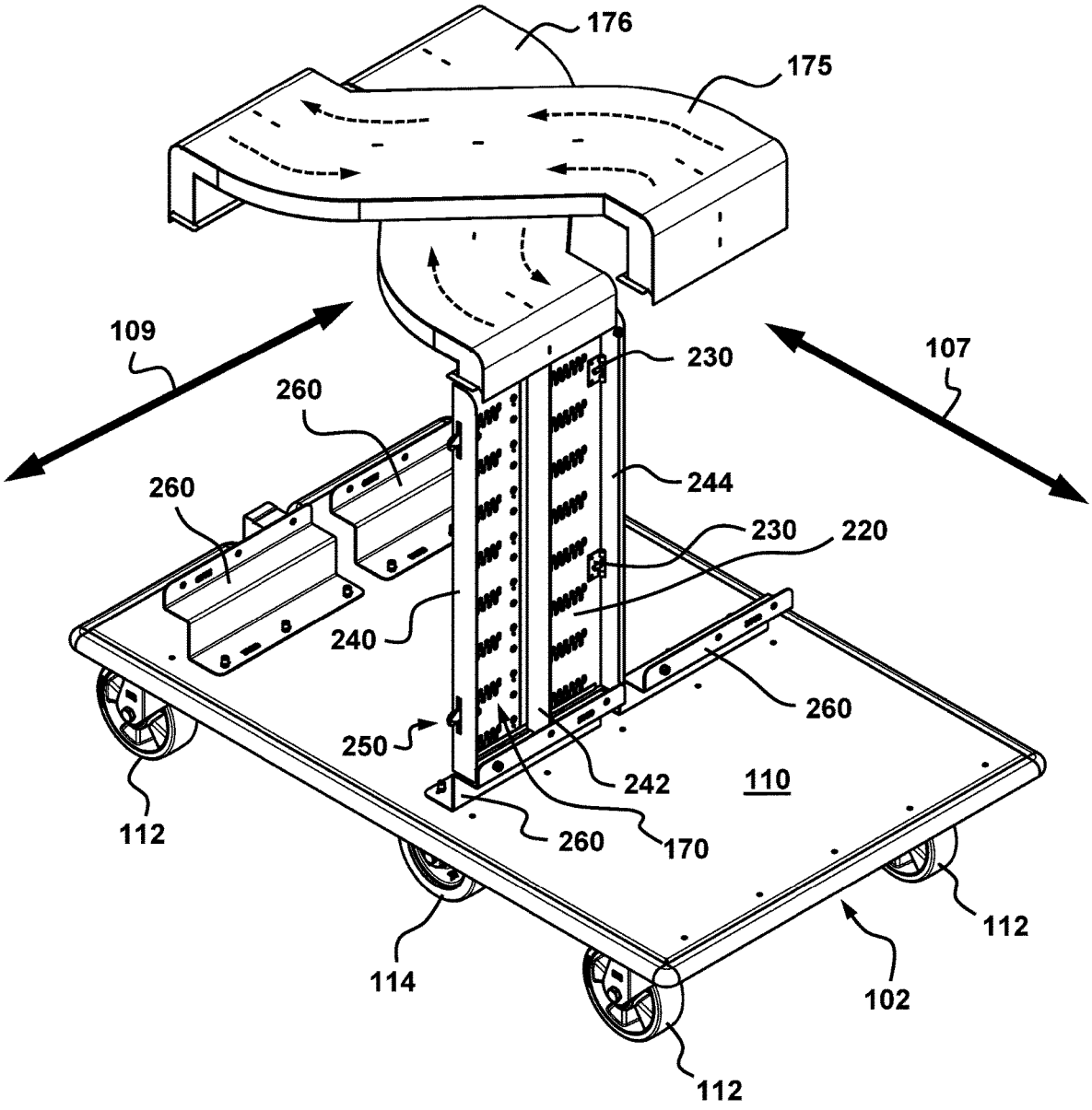
FIG. 9 is a front isometric view illustrating only the bottom base panel and some of the components of the air passage arrangement in the system of FIG. 1.

FIG. 9 is a front isometric view illustrating only the bottom base panel 110 and some of the components of the air passage arrangement of the system 100 of FIG. 1. Some of these components are parts located within the vertical air duct 170. This figure is only provided for the sake of illustration. The hinges 230 for the illustrated air distribution door 220 are visible. These hinges 230 are attached to one of the three spaced apart vertical beams 240, 242, 244, namely to the beam 244. There are air distribution doors 220 with hinges 230 on the inner side of the other vertical air ducts 171, 172, 173. As aforesaid, this configuration can greatly facilitate the cleaning of the interior of the vertical air ducts 170, 171, 172, 173. The hinges 230 can also be seen in FIG. 7A. Other configurations and arrangements are possible. Among other things, air distribution doors 220 could be replaced by other kinds of panels or be designed completely differently, including with other kinds of hinges 230 or even without hinges. Other variants are possible as well.

In FIG. 9, the middle beam 242 is also the separator wall that divides the inlet air conduit from the outlet air conduit inside this vertical air duct 170 along the entire length. Still, a locking device 250 can be provided to hold the air distribution door 220 closed during operation. The locking device 250 can use the beam 240 to hold the air distribution door 220 in place. FIG. 9 also shows that elongated bottom brackets 260 can be provided to attach the bottom of the beams 240, 242, 244 to the bottom base panel 110. Other configurations and arrangements are possible. Among other things, another kind of locking device 250 or arrangement can be used, and the locking device 250 could be omitted in some implementations. The bottom brackets 260 could be designed or configured differently, and they can be omitted in some implementations. Other variants are possible as well.

Figure 10:
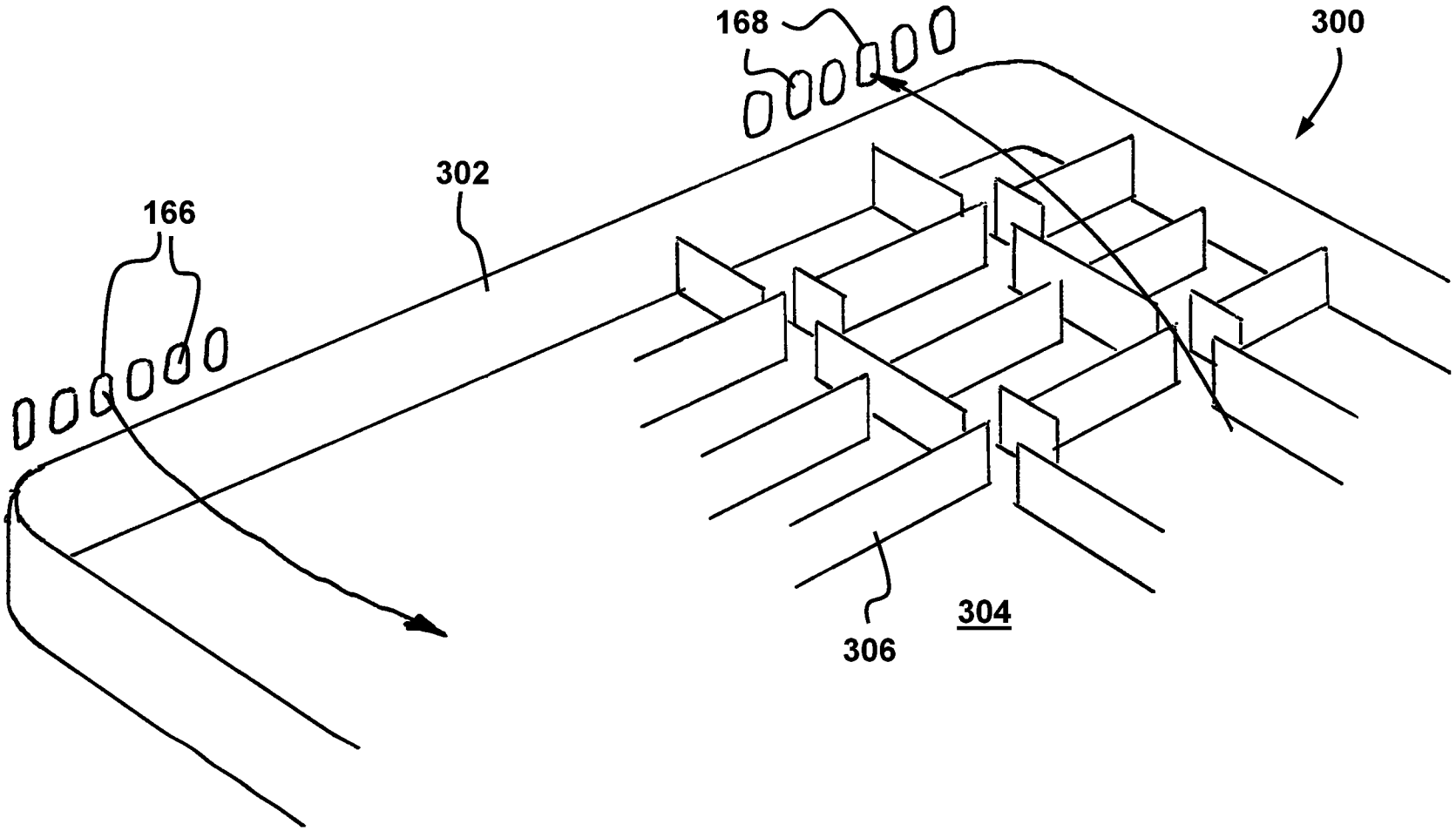
FIG. 10 is a partial and semi-schematic isometric view of an example of one of the humidifier trays provided in the system of FIG. 1.

FIG. 10 is a partial and semi-schematic isometric view of an example of one of the humidifier trays 300 provided in the system 100 of FIG. 1. The system 100 includes two of these humidifier trays 300, namely one at the bottom of each hot food products section 202A, 204A, under the bottommost of the food trays 160 on each stack. They are designed to be easily accessed, filled with water, and cleaned. They can be made a heat-resistant polymeric material, such as polyvinyl chloride (PVC) or the like. Each of the humidifier trays 300 can hold a small quantity of water, for instance between 225 ml and 1,000 ml, and at least some of this water will evaporate during the food heating mode. Air coming from the hot food products air circuit 206 below the bottommost food tray 160 of each stack will flow over the corresponding humidifier tray 300 and, since this airflow is hot during the food heating mode, it will capture some of the water released as it evaporates from the humidifier tray 300. The humidifier trays 300 can be useful to increase or at least maintain the relative humidity level of the air in the hot food products air circuit 206 during the food heating mode in a closed loop, for instance to maintain it above 50%. The hot air circulating over the hot food products during the food heating mode can often dehydrate some of these food products under certain conditions. Increasing the relative humidity level can help mitigate the dehydration. Other configurations and arrangements are possible. Among other things, the humidifier trays 300 not necessarily always increase the relative humidity level of the air, and they may instead only maintain the relative humidity level or even preventing it from decreasing too rapidly or from getting too low. The humidifier trays 300 can be made of a material other than PVC or the like. Other kinds of humidifier arrangements are possible. Humidifier arrangements and methods can also be entirely omitted in some implementations. Other variants are possible as well.

The humidifier tray 300 of the example shown in FIG. 10 includes an outer peripheral wall 302 projecting from a bottom wall 304. It also includes a plurality of vertically extending baffles 306 in the space therein. Although only a portion of these baffles 306 are semi-schematically represented in FIG. 10, there are vertically extending baffles 306 over the entire bottom area inside the water receptacle of the humidifier tray 300 to mitigate the risks of spilling the water outside the humidifier trays 300 when the food tray delivery cart 108 but without having to use a deeper water receptacle. The depth of the humidifier tray 300 can be for instance about 1 inch (2.5 cm) and the baffles 306 can have a height of about 0.5 inches (1.3 cm). In general, minimizing the depth of the water receptacle is desirable to improve the water evaporation during the food heating mode. Different regular or irregular baffle layouts are possible. The illustrated example shows vertically extending baffles 306 positioned in a labyrinth-like layout. This layout allows water poured at any location to be evenly distributed within the water receptacle. Other configurations and arrangements are possible. Among other things, the number, dimensions, and design of the humidifier trays 300, including any one of their components, can be different in some implementations. Other variants are possible as well.

Figure 11:
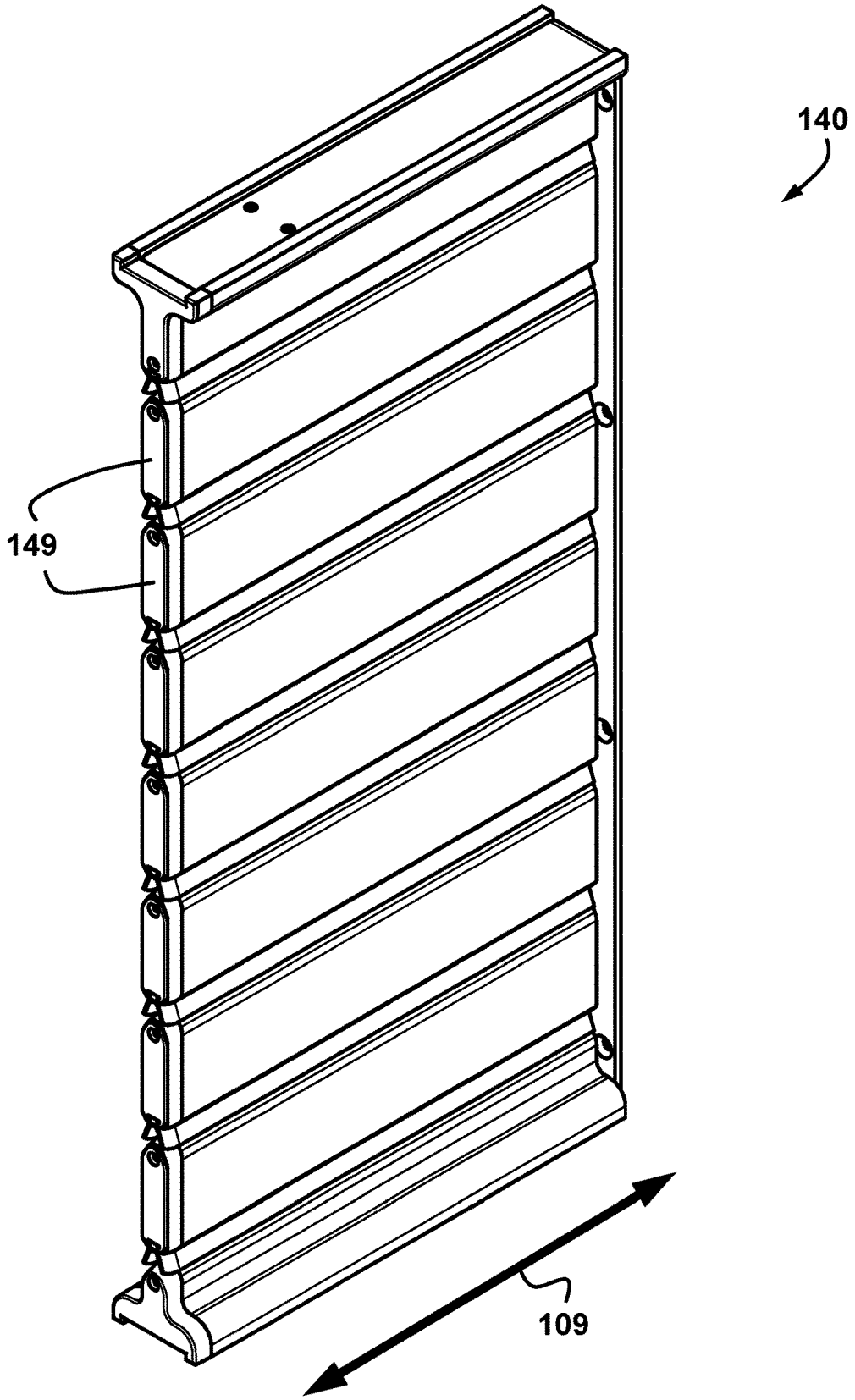
FIG. 11 is an isometric view of one of the thermal barriers provided in the system of FIG. 1.

FIG. 11 is an isometric view of one of the thermal barriers 140 provided in the system 100 of FIG. 1. Both thermal barriers 140 have an identical construction in the illustrated implementation. Each thermal barrier 140 can include a plurality of components that are easy to disassemble for cleaning and to reassemble repeatedly, as shown. FIG. 11 shows the thermal barrier 140 when fully assembled.

Figure 12:
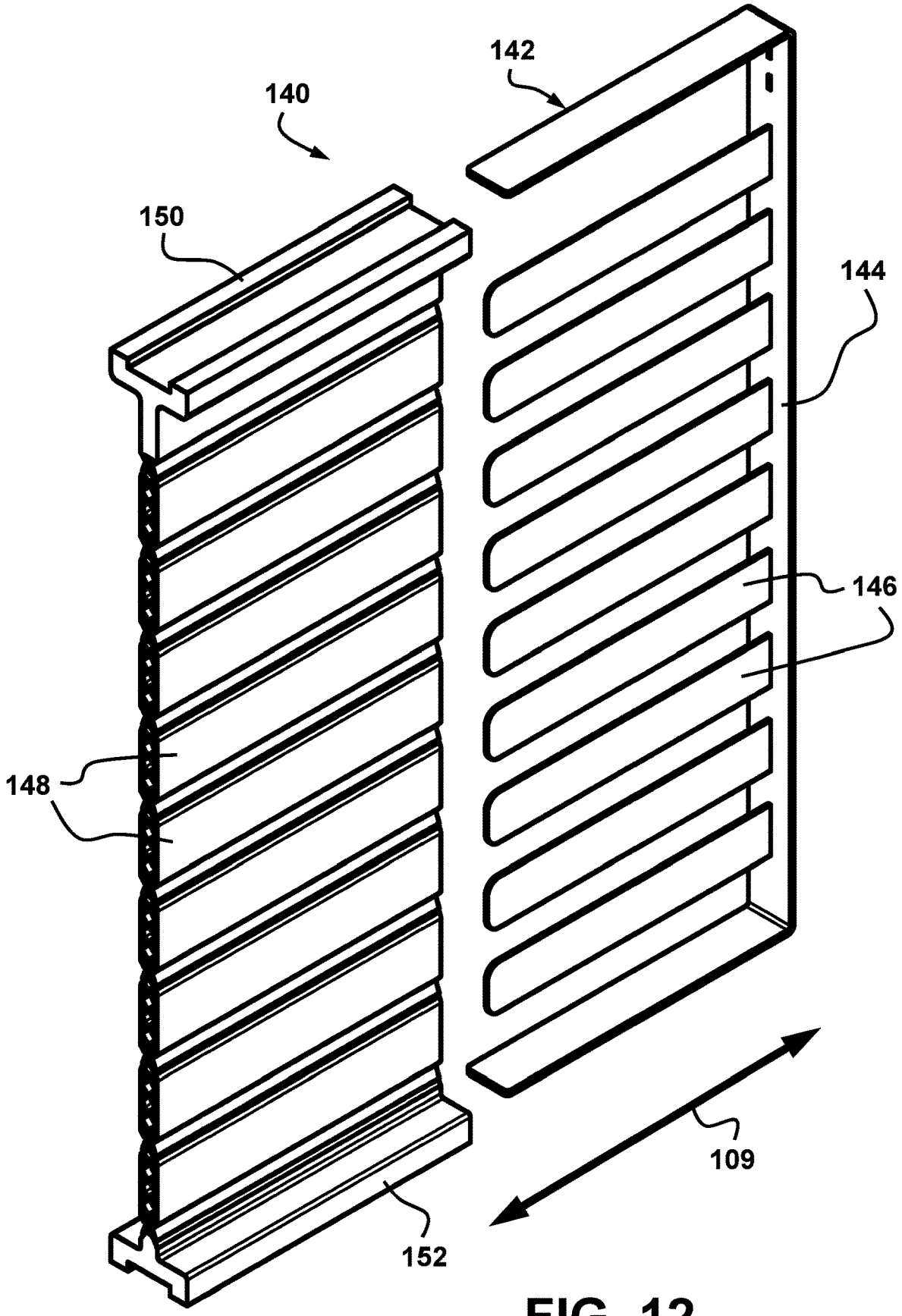
FIG. 12 is an exploded view of the thermal barrier shown in FIG. 11.

FIG. 12 is an exploded view of the thermal barrier shown in FIG. 11. As can be seen, this thermal barrier 140 includes a main support 142. The main support 142 can be made of a rigid material such as stainless steel or the like. It includes a U-shaped vertically extending beam 144 and a plurality of elongated flat blade members 146 extending horizontally from the interior side of the U-shaped beam 144, and that are vertically spaced apart from one another. The illustrated thermal barrier 140 further includes a plurality of sheaths 148, one for each blade member 146, and each sheath 148 can be removably inserted over the corresponding blade member 146. The sheaths 148 can be made of a polymeric material having a low thermal conductivity, and they can be designed and manufactured as extruded parts with internal air pockets surrounding the sleeve portion in which the corresponding blade member 146 fits. These air pockets can significantly lower the thermal conductivity, and they also minimize the quantity of material for making each sheath 148. The illustrated thermal barrier 140 also includes top and bottom members 150, 152 that are removably inserted on the topmost and bottommost segments of the U-shaped beam 144, respectively. The free end of each sheath 148, namely the end that away from the beam 144, can be sealed off or otherwise plugged, for instance using a cap 149 (FIG. 11) as shown in the example. The free end of the top and bottom members 150, 152 can also have a corresponding cap. These caps 149 can be press-fitted and/or secured using fasteners, for instance as bolts, screws or the like. They can be useful to prevent contaminants, such as the food products, from going inside the sheaths 148 and the top and bottom members 150, 152. The caps 149 can also be designed to be engaged by the interior surface of the corresponding lateral door 132 when closed. Other configurations and arrangements are possible. Among other things, the thermal barrier 140 can be designed and shaped completely differently. For instance, the caps 149 can be designed differently or even be omitted. The thermal barrier 140 can be made of a single monolithic piece in some implementations. Other materials than those indicated are possible. Other variants are possible as well.

Figure 13:
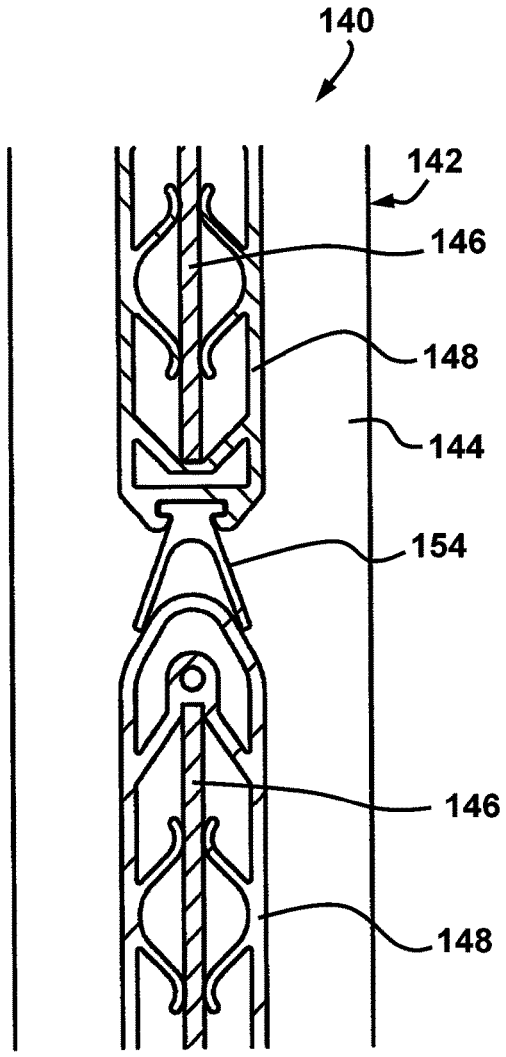
FIG. 13 is an enlarged and partial cross-sectional view of the thermal barrier shown in FIG. 11.
Figure 14:
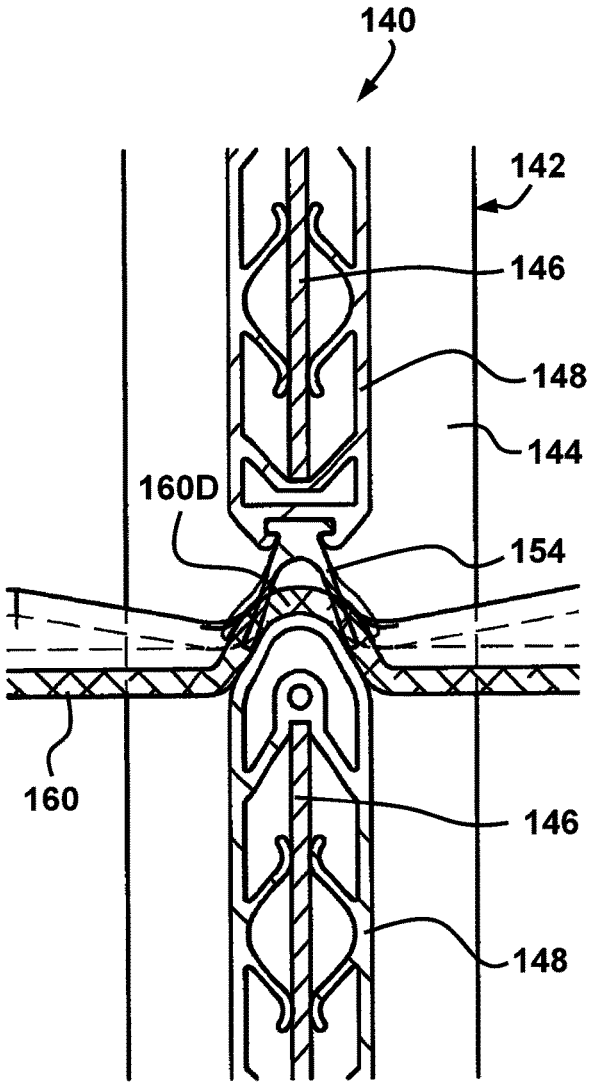
FIG. 14 shows the thermal barrier of FIG. 13 with an example of a food tray inserted therein.

FIG. 13 is an enlarged and partial cross-sectional view of the thermal barrier 140 shown in FIG. 11. It shows two of the blade members 146 and their sheaths 148. As aforesaid, the sheaths 148 can form a plurality of internal air pockets, as shown. FIG. 13 further shows that each sheath 148 can include an inverted V-shaped flexible sealing strip 154 extending along its base, with the two projecting parts generally extending downwards, as shown. The sealing strop 154 can be made of material such as silicone or the like. The sealing strip 154 can be manufactured separately and attached by inserting a corresponding base portion into a slot extending under the entire length of each sheath 148, as shown. The sealing strip 154 is provided to seal the intervening space in the space right above the demarcation line 160C between the hot and cold food products areas 160A, 160B on the food trays 160, as shown for instance in FIG. 14. FIG. 14 shows the thermal barrier 140 of FIG. 13 with an example of a food tray 160 inserted therein. The top member 150 (FIG. 12) can also include such sealing strip 154. The sealing strips 154 can also seal the spaces when no food tray is present. Other configurations and arrangements are possible. Among other things, the sealing strips 154 can be designed and/or shaped differently. It could also be replaced by other arrangements in some implementations, or even be entirely omitted in others. The sealing strips 154 can be made integral with the sheaths 148, for instance by coextrusion or the like. The sealing strips 154 can be made of a material other than silicone or the like. Other variants are possible as well.

As can be seen, the food tray 160 shown in the example of FIG. 14 includes a continuous and substantially linear ridge 160D extending from one edge to the other on the upper surface 160E. The top of this ridge 160D provides a narrow horizontal to be engaged by the bottom edge of a corresponding one of the sealing strips 154. This also shows that the food trays 160 are not necessarily flat. Other configurations and arrangements are possible. Among other things, the food trays can be designed and/or shaped differently. Other variants are possible as well.

Figure 15:
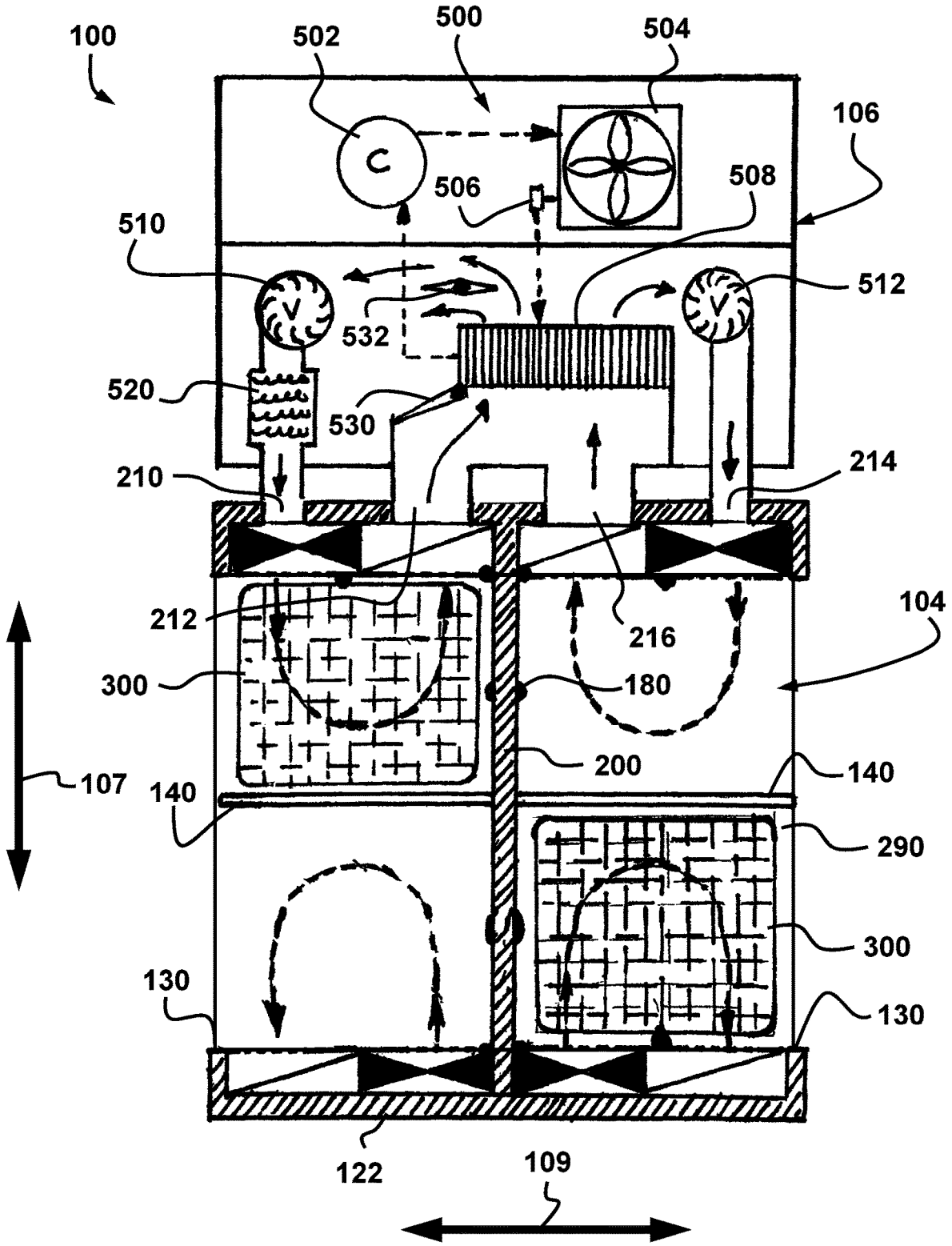
FIG. 15 is a cross-sectional plan view similar to FIG. 7A but also showing semi-schematically some of the components of the heating/cooling unit when the system is set in a food storage mode.

FIG. 15 is a cross-sectional plan view similar to FIG. 7A but also showing semi-schematically some of the components of the heating/cooling unit 106 when the system 100 is set in a food storage mode. No food tray is shown in FIG. 15, and the humidifier trays 300 are also visible in this view. They can rest on the bottom surface 290 of a corresponding one of the hot food products sections 202A, 204A.

The heating/cooling unit 106 of the illustrated example includes a refrigeration device 500 having, among other things, a compressor 502, a condenser 504, an expansion valve 506 and an evaporator 508 through which circulates a refrigerant in a closed-loop circuit. The condenser 504 is a heat exchanger that can lower the temperature of the hot refrigerant coming out at the outlet of the compressor 502, for instance using a blower forcing ambient air to go through the condenser 504 and retrieve heat from the refrigerant. The cooled refrigerant then goes through the expansion valve 506 where its pressure is significantly decreased, thereby causing its temperature to drop. The cold refrigerant flows thereafter inside the evaporator 508 and when air returning from inside the housing 104 passes through the evaporator 508, heat is transferred from the air to the cold refrigerant, thereby causing the air temperature to decrease. The refrigerant then goes back to the compressor 502, and the process is repeated. Other configurations and arrangements are possible. Among other things, the refrigeration device 500 can be designed differently. Other variants are possible as well.

The heating/cooling unit 106 can combine air returning from both air circuits 206, 208 and send it through the evaporator 508 during the food storage mode, as shown. Two fans or blowers 510, 512 are provided in this example to move air along the two air circuits 206, 208. The first blower 510 is associated with the hot food products air circuit 206, and the second blower 512 is associated with the cold air circuit 208. Air coming out of the first blower 510 passes through an electric air heater 520 before being sent to the inlet port 210 using a corresponding air conduit. However, because the heating/cooling unit 106 is currently set in the food storage mode, the air heater 520 is not generating any heat. A first air damper 530 and a second air damper 532 are provided in this example to channel air based on the selected mode. They are in a food storage configuration in FIG. 15. The first air damper 530 is in a position where air returning through the outlet port 212 will go to the evaporator 508. The second air damper 532, located downstream of the evaporator 508, is set in a position allowing some of the air that went through the evaporator 508 to go to the first blower 510. The rest of the air that went through the evaporator 508 will go to the second blower 512 and be sent to inlet port 214 using a corresponding air conduit. Other configurations are arrangements are possible. Among other things, one or more of the air dampers can be designed and/or positioned differently. Other shutter arrangements can be provided in some implementations, and they could be omitted in others. Other variants are possible as well.

Figure 16:
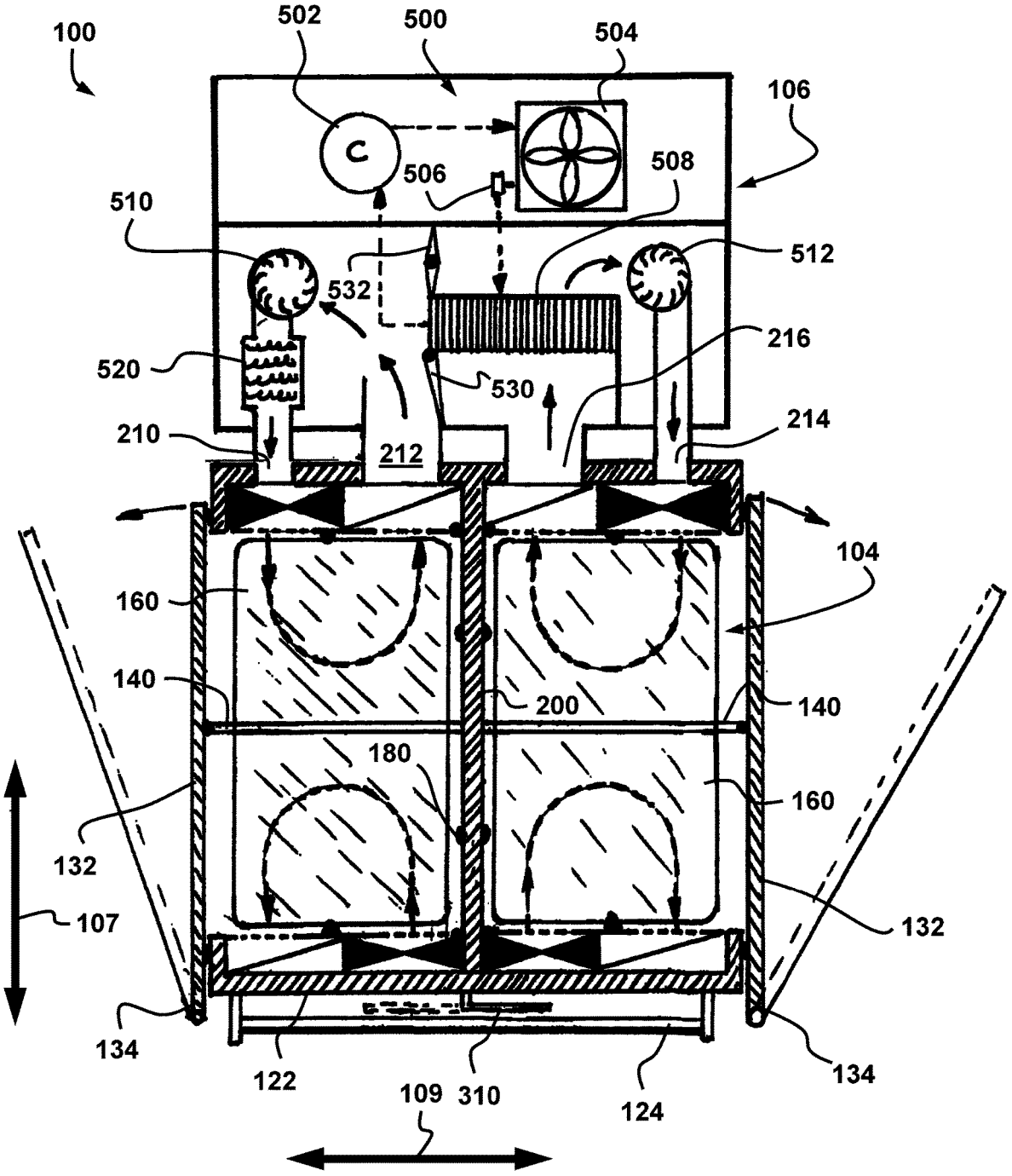
FIG. 16 is a view similar to FIG. 15 but where the system is now set in a food heating mode.

FIG. 16 is a view similar to FIG. 15 but where the system 100 is now set in the food heating mode. The first air damper 530 and the second air damper 532 are now in a food heating configuration. The first air damper 530 now redirects air coming through from the outlet port 212 directly to the inlet of the first blower 510, thereby preventing it from going through the evaporator 508. The second air damper 532 is also positioned so as to prevent air passing through the evaporator 508 from going to the first blower 510. Thus, only air coming from the outlet port 216 will go through the second blower 512 before passing through the inlet port 214. Still, air from the first blower 510 can now be heated using the air heater 520 to increase its temperature. The air temperature of the hot food products air circuit 206 can be controlled, for instance, by adjusting the amount of electrical energy going through the heating coil inside the air heater 520. One or more temperature and/or humidity sensors 180 can be provided at various locations to monitor the air temperatures and the relative humidity levels. The rotation speed of the first blower 510 can also be adjusted if needed. Likewise, the operation of the refrigeration device 500 can be controlled and/or the rotation speed of the second blower 512 can be adjusted if needed, for instance based on signals received from temperature sensors 180 provided on that side as well. The adjustments and the data monitoring can be done, for instance, through the control module 400. Other configurations are arrangements are possible.

It is worth mentioning that the illustrated refrigeration device 500 and its evaporator 508 are designed for cooling the entire content inside the two chambers 202, 204 during the food storage mode but during the food heating mode, the flow of air through the evaporator 508 will be smaller, for instance half the previous one, since only air from the cold food products air circuit 208 then goes through the evaporator 508. This can be very helpful for keeping the cold air at a low temperature in spite of all the various nearby surfaces and air spaces within the housing 104 being at a significantly hotter temperature. For instance, some heat transfer will occur even if the thermal barrier 140 between the adjacent hot and cold food products sections within each chamber 202, 204 is extremely airtight and its thermal insulation is optimal. Hence, having a smaller volume of air going through the evaporator 508 during the food heating mode can mitigate the internal heat transfers.

The food products on the hot food products area 160A on the food trays 160 are often heated until their temperature reaches a target, for instance about 75° C. The air circulating in the hot food products air circuit 206 during the food heating mode will be at least at this temperature, or at a hotter temperature, for instance about 90° C. or high, and the food heating mode is often carried out for 45 to 50 minutes until the meals on the food trays 160 are ready for serving. The heat is provided to warm the hot food products and in almost all implementations, no cooking process is carried out inside the food tray delivery cart 108. The lateral doors 132 will then be opened and the food trays 160 will be removed from the housing 104 to be presented to the persons having their meals.

The heating/cooling unit 106 will often stop when at least one of the lateral doors 132 are open. It can also run at an idle speed or lower-power setting, for instance, one that can just maintain the temperature of the hot and/or cold food products on the food trays 160 pending their removal from the housing 104. Other configurations and arrangements are possible. Among other things, and as aforesaid, other methods can be used to increase the temperature of the hot food products during the food heating mode. The target temperature of the hot food products and/or the duration of the food heating mode can be different from one implementation to another. Other variants are possible as well.

The lateral doors 132 are shown in a closed position in FIG. 16. They were closed prior to activating the food heating mode and it is generally desirable that they remain closed throughout the entire heating process. If desired, door sensors (not shown) can be provided to interrupt the food heating mode or set it to idle (i.e., where the heating/cooling unit 106 is only running a lower power level) if any one of the lateral doors 132 is open. Some implementations can include automatic door locks (not shown) to prevent the lateral doors 132 from being opened unless the food heating mode is stopped. Other configurations and arrangements are possible.

As aforesaid, the interior of the chambers 202, 204 is often cleaned after each food tray distribution run. The interior of the heating/cooling unit 106 and of the horizontal air ducts 175, 176, however, may only require an occasional cleaning, for instance because they are almost never in direct contact with any food products. These components may require a complete cleaning process after a given time in combination with a simpler cleaning procedure carried out from time to time between each complete cleaning. This simpler cleaning procedure can include a cleaning solution sprayed inside the housing 104 when it is empty so as to form a mist. The blowers 510, 512 can then run at a low speed while the lateral doors 132 are closed until all internal surfaces have received a suitable quantity of droplets of the cleaning solution to be effective. The lateral doors 132 can later be open with the blowers 510, 512 running until the cleaning solution evaporated. Other methods and approaches are possible.

Figure 17:
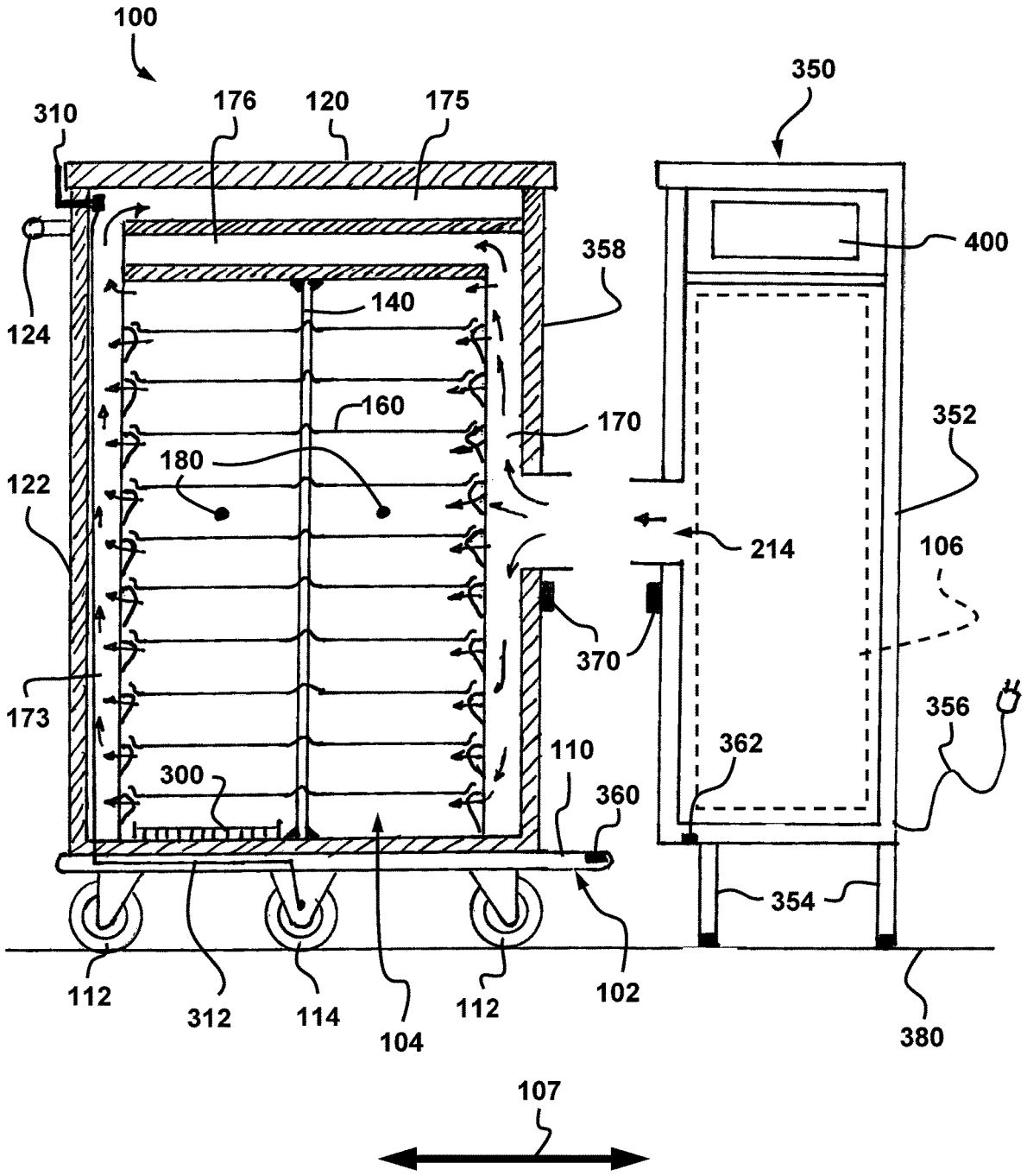
FIG. 17 is a first longitudinal cross-sectional view of another example of a system for storing and delivering food trays in which the proposed concept is implemented.

FIG. 17 is a first longitudinal cross-sectional view of another example of a system 100 for storing and delivering food trays 160 based on the proposed concept. In this example, the system 100 includes a food tray delivery cart 108 that does not have a heating/cooling unit 106 on the carriage 102. The air interconnections between the interior of the chambers 202, 204 and the heating/cooling unit 106 are made instead through what is referred to hereafter as a docking station 350. The carriage 102 can then be smaller and lighter compared to that of the system 100 of FIG. 1. The system 100 of FIG. 17 includes at least one food tray delivery cart 108 and at least one docking station 350 with a corresponding heating/cooling unit 106. The number of food tray delivery carts 108 and the number of docking stations 350, however, can be different in some implementations. For instance, the same food tray delivery cart 108 can be docked with a first docking station 350 at a first location, then moved to a second location where it will be paired with a second docking station 350. Pairing can be accomplished by positioning the front side of the food tray delivery cart 108 against a corresponding side of the docking station 350 so that the various ports 210, 212, 214, 216 can be in direct fluid communication with corresponding ports or features located on the docking station 350. Other configurations are arrangements are possible.

The docking station 350 shown in FIG. 17 includes a main outer casing 352 having a plurality of vertically extending supporting legs 354 allowing the main casing 352 to be positioned at a given distance from the floor 380. The docking station 350 can be designed to remain at the same location most of the time, and only be repositioned if this is absolutely required. The heating/cooling unit 106 inside the main casing 352 can be powered using an electric power outlet to which the distal end of a power cord 356 is connected. The docking station 350 can include a control module 400, as shown. Still, the food tray delivery cart 108 can include both a rear panel 122 and a front panel 358. The front panel 358 can include openings or other features to provide an airtight connection with the ports on the docking station 350. Other configurations and arrangements are possible. Among other things, the docking station 350 can be designed and shaped differently. The heating/cooling unit 106 do not necessarily need to be present inside the main casing 352, and can be located elsewhere in some implementations. For instance, the docking station 350 can only provide the physical interface between the food tray delivery cart 108 and the heating/cooling unit 106 during the food storage mode and the food heat mode, and the heating/cooling unit 106 does not necessarily need to be physically close to the corresponding docking station 350. A single or central heating/cooling unit 106 can be designed to work simultaneously with two or more docking stations 350. The control module 400 can be located elsewhere, and/or can include or be implemented using a plurality of submodules or other individual components, for instance one or more provided on the food tray delivery cart 108. Other variants are possible as well.

Figure 18:
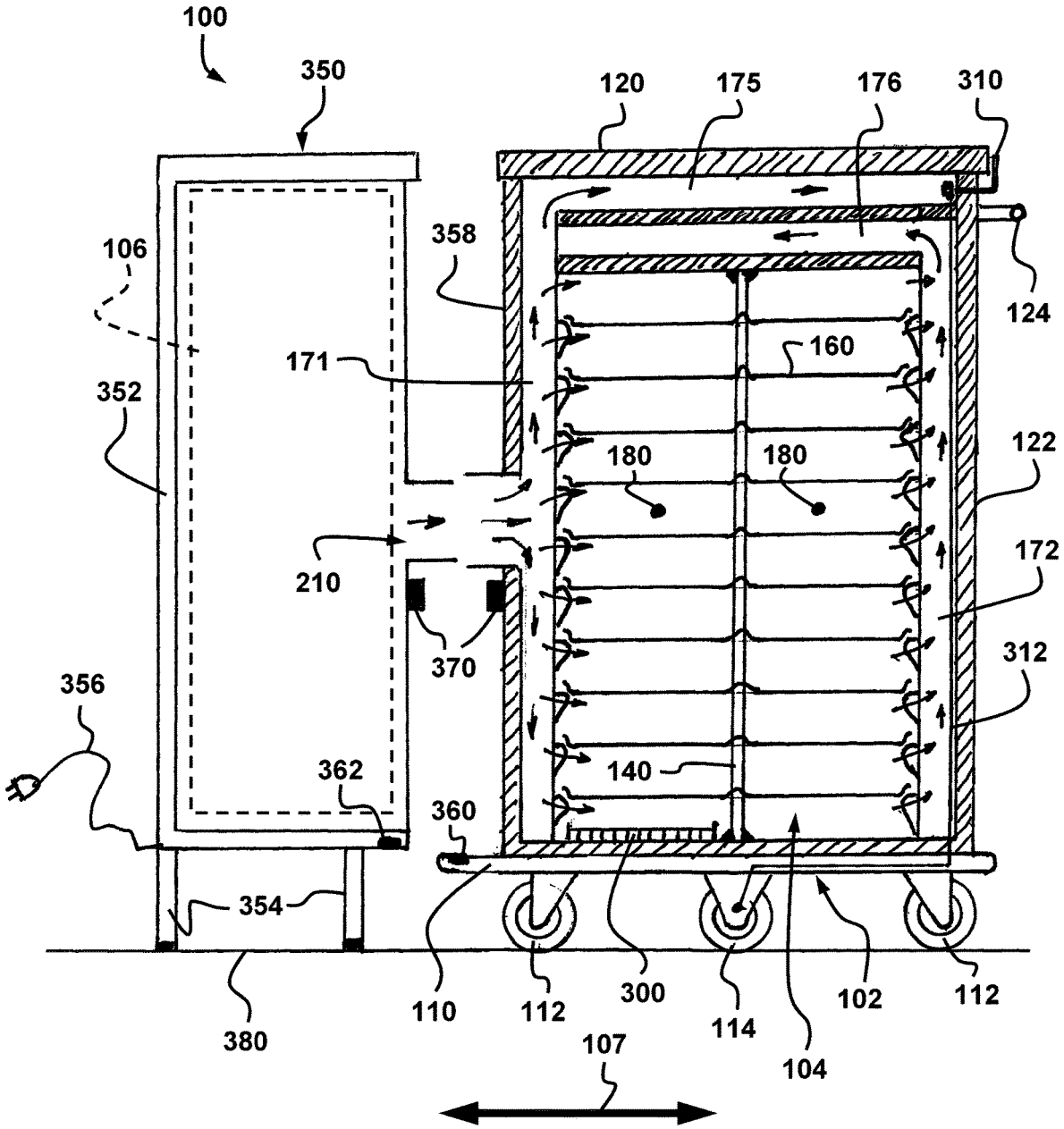
FIG. 18 is a second longitudinal cross-sectional view of the system of FIG. 17, taken from the opposite side.
Figure 19:
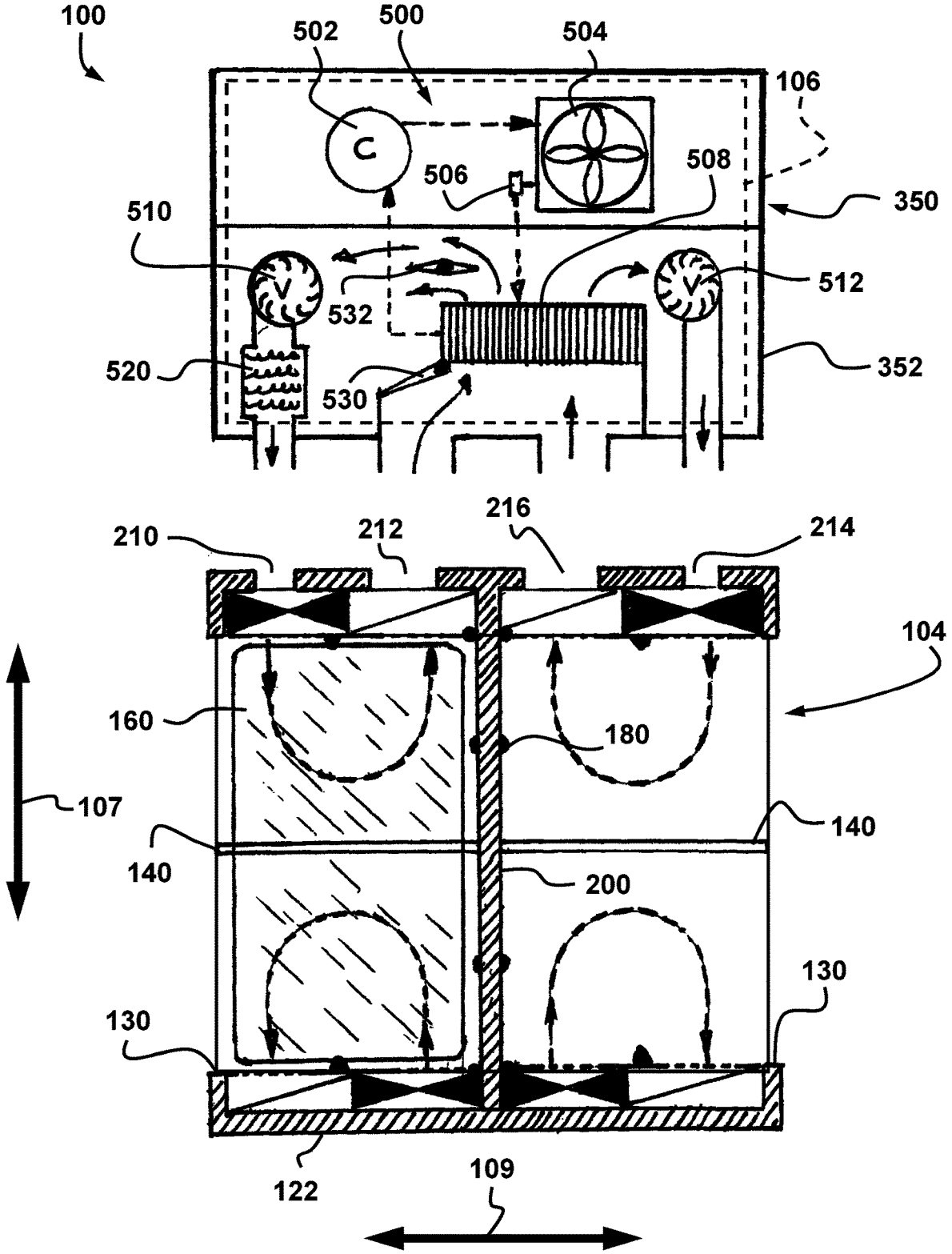
FIG. 19 is a cross-sectional plan view of the interior of the system of FIG. 17.

It should be noted that the food tray delivery cart 108 and the docking station 350 are illustrated being slightly away from one another in FIG. 17, as well as in FIGS. 18 and 19. This is only for the sake of illustration. When paired, they will engage one another with an airtight connection. One or more position sensors 360, 362 can be provided to monitor the position of the food tray delivery cart 108 and generate a signal when the front side of the food tray delivery cart 108 engages the corresponding side of the docking station 350, as shown in the illustrated example. The position sensors 360, 362 can cooperate with a locking arrangement provided to releasably secure the food tray delivery cart 108 to the docking station 350 in the docked position, as also shown in the illustrated example. This locking arrangement can include, for instance, a set of electromagnets 370. The system 100 can be designed to only activate the heating/cooling unit 106 when the electromagnets 370 are in a fully locked position. Other configurations are arrangements are possible. Among other things, the position sensors 360, 362 and/or the set of electromagnets 370 can be designed or positioned differently. One or even both of these features can be replaced by something else, or be omitted in some implementations. Other variants are possible as well.

FIG. 18 is a second longitudinal cross-sectional view of the system 100 of FIG. 17, taken from the opposite side.

FIG. 19 is a cross-sectional plan view of the interior of the system 100 of FIG. 17. It illustrates the heating/cooling unit 106 of the system 100 of FIG. 17 being set in the food storage mode as shown in FIG. 15. Although not illustrated, the heating/cooling unit 106 of this system 100 can also be set in the food heating mode like in FIG. 16. Reference is made to the explanations provided for FIGS. 15 and 16.

Figure 20:
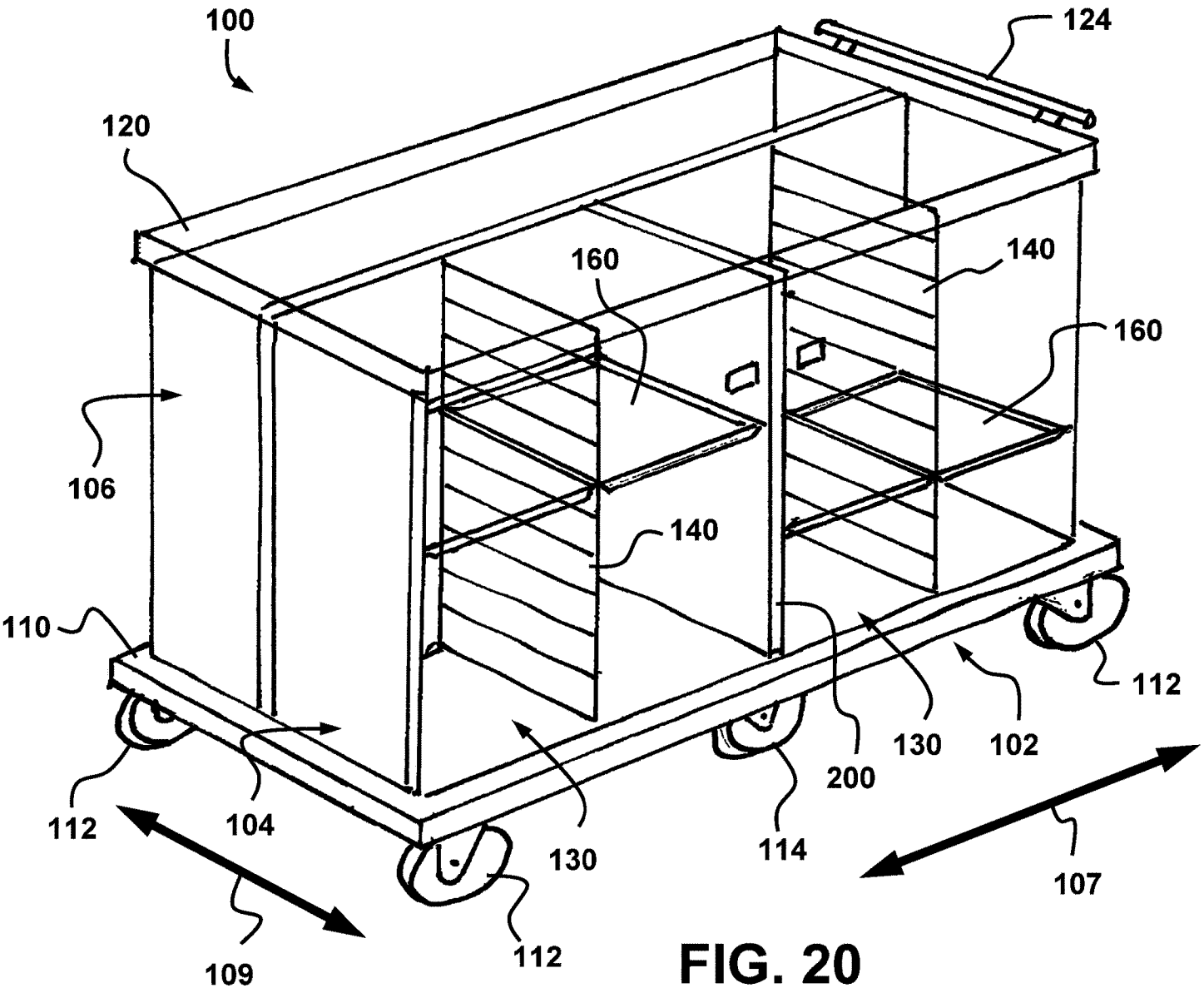
FIG. 20 is a semi-schematic front isometric view of another example of a system for storing and delivering food trays.
Figure 21:
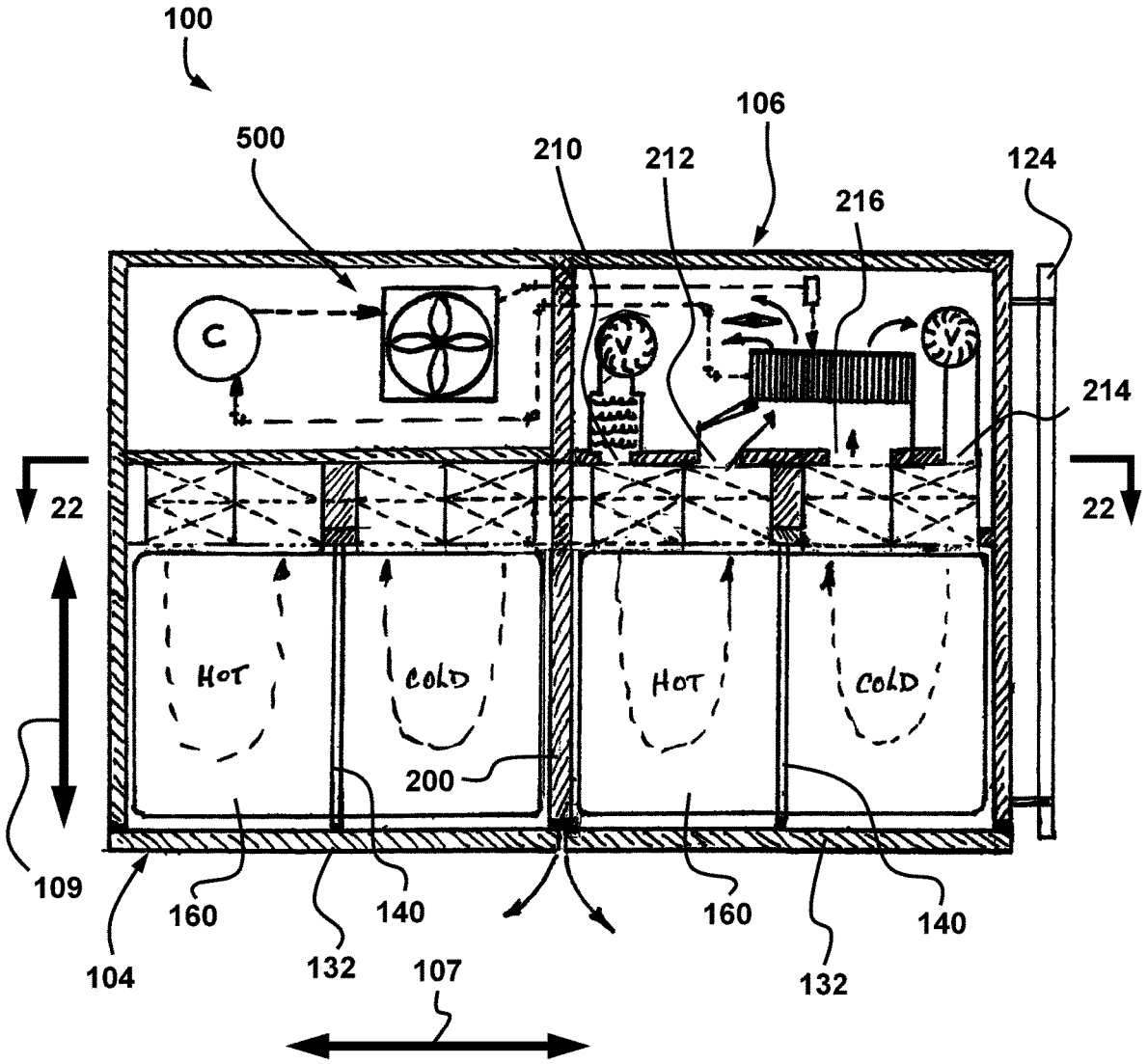
FIG. 21 is a cross-sectional plan view of the interior of the system of FIG. 20, with the system being in the food storage mode.

FIG. 20 is a semi-schematic front isometric view of another example of a system 100 for storing and delivering food trays 160. Some of the components are omitted, and others are semitransparent for the sake of illustration. As can be seen, the system 100 in the example includes both a housing 104 and a heating/cooling unit 106 located over a bottom base panel 110 of a wheeled carriage 102. This system 100, however, includes two lateral openings 130 that are juxtaposed on the same lateral side, the housing 104 extending longitudinally on the left side of the food tray delivery cart 108. The heating/cooling unit 106 extends longitudinally on the right side thereof in this example. There are two separate chambers 202, 204, and each chamber 202, 204 is divided into hot and cold food products sections by a corresponding thermal barrier 140. The two chambers 202, 204, however, are juxtaposed side-by-side instead of being back-to-back, and the partition wall 200 extends in the transversal axis 109 in the system 100 of FIG. 20. The partition wall 200 is thus parallel to the thermal barriers 140 in this example. Each food products section of the chambers 202, 204 corresponds to a stack of food trays 160 and its lateral opening 130 can be closed by a lateral door 132 (FIG. 21). The food trays 160 can be loaded through both lateral openings 130 with the same orientation, for instance with the hot food products area 160A of each food tray 160 to the left and the cold food products area 160B to the right. Other configurations and arrangements are possible. Among other things, the housing 104 and its lateral openings 130 can be provided, for instance, on the right side of the system 100 in some implementations. Both lateral openings 130 can be closed using a single lateral door 132 instead of two. Some systems 100 can be designed to receive more than two stacks of food trays 160, thus include more than two lateral openings side-by-side, particularly if the system 100 is designed for smaller food trays. Some implementations can be designed to receive food trays 160 of different sizes, one stack being configured for instance to receive a first set of food trays and another stack being configured to receive a second set of food trays having a different length and/or width than that of the food trays in the first set. Other variants are possible as well.

The food tray delivery cart 108 of FIG. 20 can be somewhat similar to that of the system 100 of FIG. 1, for instance having ground-engaging wheels 112, 114 and a handle 124 provided at the back. Other configurations and arrangements are possible. Among other things, the food tray delivery cart 108 in the system 100 of FIG. 20 can be modified or otherwise redesigned as previously presented in the text concerning the other examples. This includes having only the housing 104 on the carriage 102, the heating/cooling unit 106 being, for instance, provided in or being otherwise accessed through a docking station or another arrangement. Other variants are possible as well.

The heating/cooling unit 106 is provided along the right side of the food tray delivery cart 108 in FIG. 20, thus along the back side of the housing 104 in this example. As aforesaid, the housing 104 and its lateral openings 130 could be on the right and the heating/cooling unit 106 on the left. The heating/cooling unit 106 provides the hot and cold food products air circuits 206, 208 passing through the corresponding food products sections. Other configurations and arrangements are possible.

FIG. 21 is a cross-sectional plan view of the interior of the system 100 of FIG. 20, with the system 100 being set in the food storage mode. The heating/cooling unit 106 and the associated air passage arrangement are only semi-schematically depicted. The heating/cooling unit 106 can include components identical or similar to those presented in FIG. 15. The operation of the refrigeration device 500 and the associated components is essentially the same and need not to be repeated. Air is supplied and returns through corresponding ports provided at the back of one of the food products sections. Air flows independently along the air circuits 206, 208. Other configurations and arrangements are possible. Among other things, the various components of the heating/cooling unit 106 and/or of the air passage arrangement, including the air ports, can be designed and/or be positioned differently in some implementations. The heating/cooling unit 106 can also be set in a food heating mode, thus operate as shown in FIG. 16. Other variants are possible as well.

Figure 22:
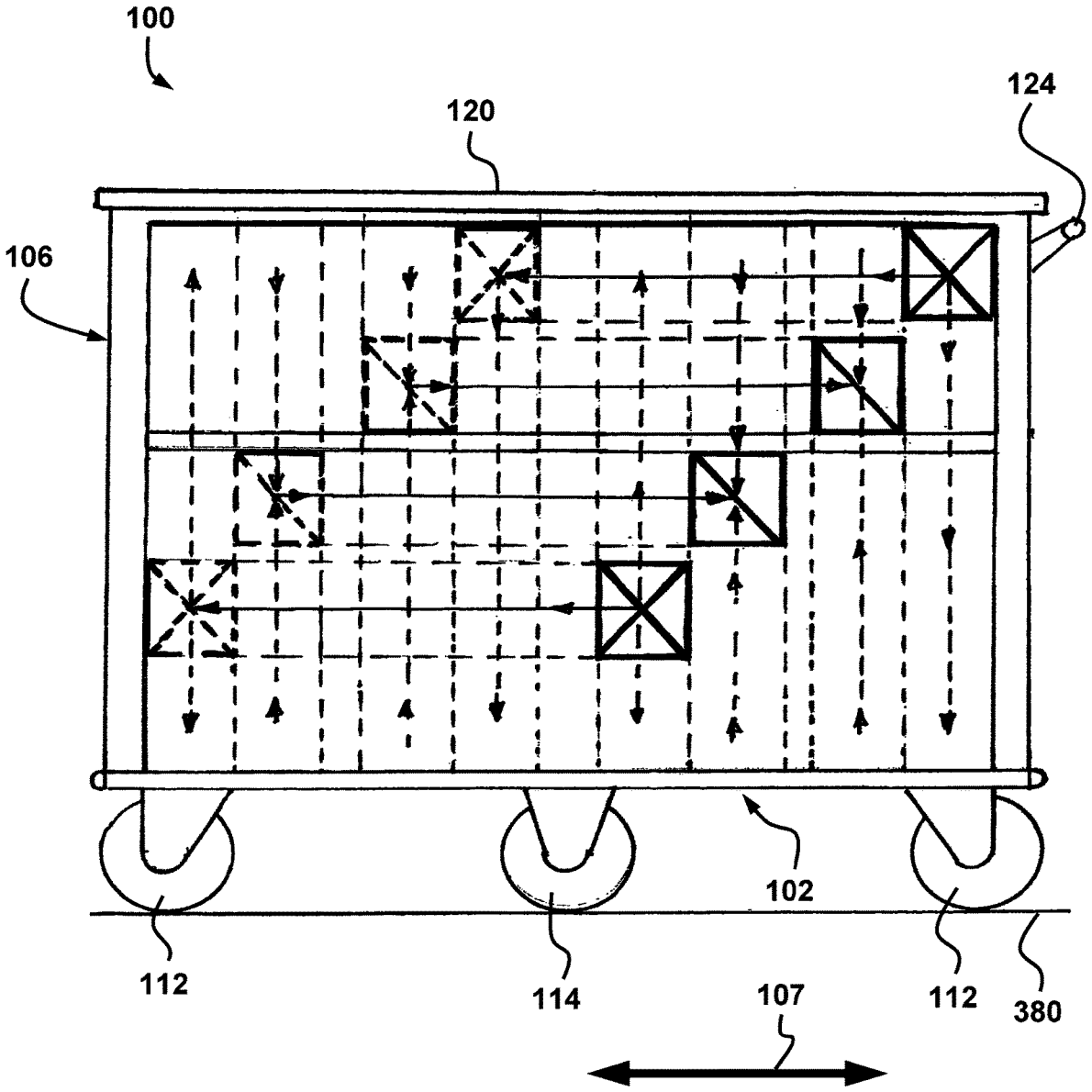
FIG. 22 is a longitudinal cross-sectional view taken along line 22-22 in FIG. 21.

FIG. 22 is a longitudinal cross-sectional view taken along line 22-22 in FIG. 21. It shows semi-schematically an example of the fluid communication between the air conduits. Like the systems 100 of the other examples, this system 100 can include four vertical air ducts and each of them can include a longitudinally extending internal separator wall creating two separate air conduits in which air flows substantially in opposite directions. The air conduits located inside the vertical air ducts that are positioned in the food products section away from the air ports receive and return air through corresponding horizontal air conduits. These separate horizontal air conduits can be created inside horizontal air ducts divided in two using a longitudinally extending internal separator wall and/or through separate air ducts or air passages. The air passage arrangement is designed so that air from each air circuit 206, 208 will enter the corresponding air spaces over and under the hot and cold food products areas 160A, 160B on the food trays 160 using air apertures 166, 168 (shown in the other examples). As can be seen, the air passage arrangement in this example includes a combination of horizontal and vertical air ducts, like in the other examples.

The panels at the back of each housing section can also be designed to open so as to facilitate cleaning. Other configurations and arrangements are possible. Among other things, the design and the position of the air passage arrangement can be different in some implementations. Others may even include two heating/cooling units, one for each chamber 202, 204, mounted over the food tray delivery cart 108. Some implementations can be made without having horizontal and vertical air ducts. For instance, one or more can be obliquely oriented, or be designed completely differently. Other variants are possible as well.

The present detailed description and the appended figures are meant to be exemplary only, and a skilled person will recognize that variants can be made in light of a review of the present disclosure without departing from the proposed concept. Among other things, and unless otherwise explicitly specified, none of the parts, elements, characteristics or features, or any combination thereof, should be interpreted as being necessarily essential to the invention simply because of their presence in one or more examples described, shown and/or suggested herein.

LIST OF REFERENCE NUMERALS

100 system
102 carriage
104 housing
106 heating/cooling unit
107 longitudinal axis
108 food tray delivery cart
109 transversal axis
110 bottom base panel
112 caster wheel
114 caster wheel

116 power cord
118 outer shell
120 top panel
122 rear panel
124 handle
130 lateral opening
132 lateral door
133 door catch
134 hinge
136 protective casing
138 door (of the protective casing)
140 thermal barrier
142 main support
144 U-shaped beam
146 blade member
148 sheath
149 cap
150 top member
152 bottom member
154 flexible sealing strip
160 food tray
160A hot food products area
160B cold food products area
160C demarcation line
160D transversal ridge
160E upper surface
160F loading/unloading direction
161 standpoint
162 support (of tray supporting arrangement)
164 air diffuser panel
166 incoming air aperture
168 outgoing air aperture
170 vertical double air duct
171 vertical double air duct
172 vertical double air duct
173 vertical double air duct
175 horizontal double air duct
176 horizontal double air duct
180 temperature and/or humidity sensors
200 partition wall
202 first chamber
202A hot food products section of the first chamber
202B cold food products section of the first chamber
204 second chamber
204A hot food products section of the second chamber
204B cold food products section of the second chamber
206 hot food products air circuit
208 cold food products air circuit
210 inlet port (of the hot food products air circuit)
212 outlet port (of the hot food products air circuit)
214 inlet port (of the cold food products air circuit)
216 outlet port (of the cold food products air circuit)
220 air distribution door
230 hinge (of the air distribution door)
240 vertical beam
242 vertical beam
244 vertical beam
250 locking device
260 bottom bracket
290 bottom surface
300 humidifier tray
302 outer peripheral wall
304 bottom wall
306 baffle (in the humidifier tray)
310 brake lever
312 brake cable
350 docking station
352 main outer casing (of docking station)
354 supporting leg
356 power cord
358 front panel
360 position sensor
362 position sensor
370 electromagnet
380 floor
400 control module
402 display screen
500 refrigeration device
502 compressor
504 condenser
506 expansion valve
508 evaporator
510 first blower
512 second blower
520 air heater
530 first air damper
532 second air damper

What is claimed is:

1. A system for storing and delivering individual food trays, each food tray having separate hot and cold food products areas on opposite sides of a transversal demarcation line, the system including:

a housing having two lateral doors to selectively open and close a respective one among two opposite lateral openings, the housing including separate first and second chambers, each chamber having an enclosed internal space accessed through a respective one of the lateral openings, each chamber including:

a tray supporting arrangement having a plurality of vertically spaced stacking positions, each stacking position corresponding to a stowage space for receiving one of the food trays with the chamber through the respective lateral opening; and a vertically extending thermal barrier to divide the enclosed internal space within the chamber into separate vertically extending hot and cold food products sections along the demarcation line on the food trays; and when viewed from above, the hot food products section of the first chamber and the hot food products section of the second chamber are diametrically opposite to one another, and the cold food products section of the first chamber and the cold food products section of the second chamber are diametrically opposite to one another, wherein the system includes an air passage arrangement forming a hot food products air circuit and a cold food products air circuit that are separate from one another.

2. The system as defined in claim 1, the hot food products air circuit including a first portion passing inside the hot food products section of the first chamber, and including a second portion passing inside the hot food products section of the second chamber, the cold food products air circuit including a first portion passing inside the cold food products section of the second chamber, and including a second portion passing inside the cold food products section of the first chamber.

3. The system as defined in claim 2, wherein the air passage arrangement includes a first set of inlet and outlet ports and a second set of inlet and outlet ports, the hot food products air circuit extending between the inlet and outlet ports of the first set, and the cold food products air circuit extending between the inlet and outlet ports of the second set.

4. The system as defined in claim 3, wherein the air passage arrangement includes:

a first pair of separate vertical air conduits in which the hot food products air circuit has opposite incoming and outgoing flow paths, the first pair of vertical air conduits being substantially adjacent and parallel to one another and forming a first vertical double air duct, the first vertical double air duct having an air diffuser panel extending along one side of the hot food products section of the first chamber;

a second pair of separate vertical air conduits in which the hot food products air circuit passes following opposite incoming and outgoing flow paths, the second pair of vertical air conduits being substantially adjacent and parallel to one another and forming a second vertical double air duct, the second vertical double air duct having an air diffuser panel extending along one side of the hot food products section of the second chamber;

a third pair of separate vertical air conduits in which the cold food products air circuit passes following opposite incoming and outgoing flow paths, the third pair of vertical air conduits being substantially adjacent and parallel to one another and forming a third vertical double air duct, the third vertical double air duct having an air diffuser panel extending along one side of the cold food products section of the second chamber; and a fourth pair of separate vertical air conduits in which the cold food products air circuit passes following opposite incoming and outgoing flow paths, the fourth pair of vertical air conduits being substantially adjacent and parallel to one another and forming a fourth vertical double air duct, the fourth vertical double air duct having an air diffuser panel extending along one side of the cold food products section of the first chamber.

5. The system as defined in claim 4, wherein the air passage arrangement includes a first pair of separate horizontal air conduits that are substantially adjacent and parallel to one another and in which the hot food products air circuit follows opposite incoming and outgoing flow paths, and a second pair of separate horizontal air conduits that are substantially adjacent and parallel to one another and in which the cold food products air circuit follows opposite incoming and outgoing flow paths, the first and second pairs of horizontal air conduits being located above the enclosed internal spaces within the chambers.

6. The system as defined in claim 5, wherein the air conduits of the first pair of horizontal air conduits form a first horizontal double air duct, and the air conduits of the second pair of horizontal air conduits form a second horizontal double air duct, one among the first and second horizontal air ducts being positioned vertically above the other, the first and second horizontal air ducts having a substantially X-shaped configuration when viewed from above.

7. The system as defined in claim 6, wherein each air conduit of the first horizontal double air duct establishes a direct fluid communication between a corresponding one of the air conduits of the first vertical double air duct and a corresponding one of the air conduits of the second vertical double air duct, and wherein each air conduit of the second horizontal double air duct establishes a direct fluid communication between a corresponding one of the air conduits of the third vertical double air duct and a corresponding one of the air conduits of the fourth vertical double air duct.

8. The system as defined in claim 7, wherein each air diffuser panel includes a plurality of sets of air apertures, each set being in registry with a respective one of the stowage spaces within the corresponding chamber and including at least one incoming air aperture and at least one outgoing air aperture that are configured and disposed to create a local air circuit subbranch within each stowage space.

9. The system as defined in claim 8, wherein each air diffuser panel of the first and second vertical double air ducts includes an additional set of air apertures in registry with a bottom airspace within the corresponding hot food products section that is immediately vertically below a bottommost of the stowage spaces, the additional set including at least one incoming air aperture and at least one outgoing air aperture that are configured and disposed to create an additional local air circuit subbranch within the bottom airspace, and wherein the system further includes a humidifier tray provided within each bottom airspace and over which passes the corresponding additional local air circuit subbranch.

10. The system as defined in claim 9, wherein each humidifier tray includes a water receptacle having a plurality of vertically extending baffles positioned in a labyrinth-like layout.

11. The system as defined in claim 3, wherein the system further includes a wheeled carriage over which the housing is mounted to form a food tray delivery cart.

12. The system as defined in claim 11, wherein the system further includes a heating/cooling unit mounted over the carriage for supplying thermally regulated air into the air circuits.

13. The system as defined in claim 12, wherein the heating/cooling unit includes a set of internal air dampers having a food storage configuration and a food heating configuration, the food storage configuration establishing a first internal flow path going from the first outlet port to an evaporator, through the evaporator, and then from the evaporator to the first inlet port, and the food heating configuration establishing a second internal air flow path going from the first outlet port to the first inlet port and bypassing the evaporator.

14. The system as defined in claim 13, wherein in the food storage configuration, the first inlet port is in fluid communication within the heating/cooling unit with the first and second outlet ports, and in the food heating configuration, the first inlet port is in fluid communication within the heating/cooling unit with only the first outlet port, the heating/cooling unit including an air hearer to supply heat to air following the second internal air flow path before exiting the heating/cooling unit.

15. The system as defined in claim 13, wherein the system further includes a control module mounted on the food tray delivery cart, the control module providing a selection between a food storage mode or in a food heating mode, the internal air dampers being set in the food storage configuration during the food storage mode, and being set in the food heating configuration during the food heating mode.

16. The system as defined in claim 11 wherein the system includes a docking station, the food tray delivery cart being movable relative to the docking station between a docked and an undocked position, the food tray delivery cart, when in the docked position, establishing a cooperative engagement with the docking station for supplying thermally regulated air into the air circuits.

17. The system as defined in claim 16, wherein the system further includes a heating/cooling unit provided inside the docking station.

18. The system as defined in claim 16, wherein the system further includes:

a locking arrangement to releasably secure the food tray delivery cart to the docking station in the docked position, and at least one position sensor cooperating with the locking arrangement.

19. The system as defined in claim 1, wherein the first chamber and the second chamber are separated from one another within the housing by an intervening vertically extending partition wall.

20. The system as defined in claim 1, wherein each of the lateral doors is pivotally mounted to a corresponding structural member of the housing.

* * * * *